US008246400B2

(12) United States Patent
Ichikawa et al.

(10) Patent No.: US 8,246,400 B2
(45) Date of Patent: Aug. 21, 2012

(54) STEERING APPARATUS FOR PROPULSION DEVICE AND PROPULSION DEVICE

(75) Inventors: Yoshiyuki Ichikawa, Shizuoka (JP); Yukinori Nose, Shizuoka (JP); Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 256 days.

(21) Appl. No.: 12/685,020

(22) Filed: Jan. 11, 2010

(65) Prior Publication Data

US 2010/0178818 A1 Jul. 15, 2010

(30) Foreign Application Priority Data

Jan. 14, 2009 (JP) ..... 2009-005820
Jan. 14, 2009 (JP) ..... 2009-005917

(51) Int. Cl.
*B63H 5/125* (2006.01)
*G05D 1/02* (2006.01)

(52) U.S. Cl. ..... 440/55; 440/58; 114/144 RE

(58) Field of Classification Search ..... 440/1, 53, 440/55, 56, 58, 59; 114/144 R, 144 RE
See application file for complete search history.

(56) References Cited

U.S. PATENT DOCUMENTS 2,095,031 A * 10/1937 Holmes ..... 114/144 R
3,039,420 A * 6/1962 Bevis et al. ..... 440/62
4,263,994 A * 4/1981 Hayes ..... 188/67
4,419,084 A * 12/1983 Borst ..... 440/58
4,710,141 A * 12/1987 Ferguson ..... 440/61 R
5,105,924 A * 4/1992 Carlson ..... 192/223.2
5,240,445 A * 8/1993 Aoki et al. ..... 440/58
5,423,277 A * 6/1995 Gai ..... 114/144 R
6,790,110 B2 * 9/2004 Ozawa ..... 440/61 S
6,892,662 B2 * 5/2005 Watanabe et al. ..... 114/144 R
7,263,943 B2 * 9/2007 Takada et al. ..... 114/144 E
7,267,587 B2 * 9/2007 Oguma et al. ..... 440/58
7,497,183 B2 * 3/2009 Dudra et al. ..... 114/150
7,517,262 B2 * 4/2009 Mizutani ..... 440/59
2006/0166567 A1 7/2006 Otobe et al.
2009/0084299 A1 4/2009 Mizutani

FOREIGN PATENT DOCUMENTS

JP 2794779 B2 9/1998
JP 2004-231108 A 8/2004
JP 2009-83596 A 4/2009

* cited by examiner

*Primary Examiner* — Lars A Olson
*Assistant Examiner* — Andrew Polay
(74) *Attorney, Agent, or Firm* — Keating & Bennett, LLP

(57) ABSTRACT

A steering apparatus for a propulsion device includes a swivel portion, a motor, a lock portion, and a lock release mechanism. The motor is arranged to generate a driving force to turn the propulsion device main body in right and left directions. The lock portion is provided in a transmission path of the driving force. The lock portion is arranged to transmit a force from an upstream side to a downstream side thereof and to be locked when a force is applied from the downstream side to thereby prevent a turning of the propulsion device main body in the right and left directions. The lock release mechanism is provided in the transmission path at the downstream side relative to the lock portion. The lock release mechanism is arranged to shut off or stop a transmission of force to the upstream side thereof to thereby prevent application of the force to the lock portion.

20 Claims, 27 Drawing Sheets

STEERING APPARATUS FOR PROPULSION DEVICE AND PROPULSION DEVICE

BACKGROUND OF THE INVENTION

1. Field of the Invention

The present invention relates to a steering apparatus for a propulsion device and a propulsion device that includes the steering apparatus.

2. Description of the Related Art

A propulsion device according to a prior art is an outboard motor, as disclosed in U.S. Patent Application Publication No. 2006/0166567 A1. The outboard motor includes a steering apparatus arranged to turn an outboard motor main body in right and left directions with respect to a hull. The steering apparatus includes a steering motor that generates a driving force to turn the outboard motor main body in the right and left directions. When a steering wheel provided in the hull is operated, an electrical signal is transmitted to the motor. The motor is driven based on the transmitted electrical signal. The outboard motor main body is thereby turned in the right and left directions.

SUMMARY OF THE INVENTION

The inventors of preferred embodiments of the present invention described and claimed in the present application conducted an extensive study and research regarding a steering apparatus for a propulsion device and a propulsion device, such as the one described above, and in doing so, discovered and first recognized new unique challenges and previously unrecognized possibilities for improvements as described in greater detail below.

That is, with the propulsion device according to the above-mentioned prior art, a reaction force that the outboard motor main body receives from water during running of the hull is transmitted to the motor. The motor must thus be driven constantly to maintain an orientation of the outboard motor main body during the running of the hull. A high load is thus placed on the motor.

In order to overcome the previously unrecognized and unsolved problems described above, a preferred embodiment of the present invention provides a steering apparatus for a propulsion device including a swivel portion, a motor, a lock portion, and a lock release mechanism. The swivel portion is arranged to attach a propulsion device main body to a hull such that the propulsion device main body is capable of turning in right and left directions. The motor is provided at the swivel portion. The motor is arranged to generate a driving force to turn the propulsion device main body in the right and left directions. The lock portion is provided in a transmission path of the driving force. The lock portion is arranged to transmit a force from an upstream side to a downstream side of the lock portion and to be locked when a force is applied from the downstream side to thereby prevent turning of the propulsion device main body in the right and left directions. The lock release mechanism is provided in the transmission path at a downstream side relative to the lock portion. The lock release mechanism is arranged to shut off or stop a transmission of force to an upstream side of the lock release mechanism to thereby prevent application of the force to the lock portion.

By this arrangement, when a force (for example, a reaction force from water) that turns the propulsion device main body in the right and left directions is applied to the propulsion device main body, the force is transmitted to the lock portion. That is, the force applied to the propulsion device main body is applied to the lock portion from the downstream side. The lock portion thereby is locked and locks the turning of the propulsion device main body in the right and left directions. Thus, even if the motor is not driven during running of the hull, the turning of the propulsion device main body in the right and left directions is locked and prevented by the lock portion. The motor thus does not have to be driven constantly during the running of the hull. A load of the motor is thereby reduced. Further, the locking of the propulsion device main body by the lock portion is released by the lock release mechanism. A user can thus release the locking of the propulsion device main body by the lock portion and, for example, push the propulsion device main body to turn the propulsion device main body in the right and left directions.

The steering apparatus for a propulsion device may further include a transmitting mechanism provided in the transmission path at the downstream side relative to the lock portion and arranged to transmit force from an upstream side to a downstream side of the transmitting mechanism and from the downstream side to the upstream side of the transmitting mechanism. In this case, the lock release mechanism may be arranged to stop a transmission of force by the transmitting mechanism.

Also, the transmitting mechanism may include a gear mechanism including a plurality of engaged gears. In this case, the lock release mechanism may be arranged to release an engagement of at least one pair of gears among the plurality of gears.

The gear mechanism may include an input gear, an output gear, and an intermediate gear. The input gear may be arranged such that the driving force of the motor is supplied to the input gear. The output gear may be arranged to output the driving force. The intermediate gear may be engaged with the input gear and the output gear. The intermediate gear may be arranged to transmit the driving force from the input gear to the output gear. The lock release mechanism may be arranged to release at least one of either an engagement of the input gear with the intermediate gear or an engagement of the output gear with the intermediate gear.

Also, the transmitting mechanism may include a gear mechanism including a plurality of engaged gears. In this case, the lock release mechanism may further include a holding member detachably coupled to the swivel portion and arranged to hold at least one of the plurality of gears.

Also, the lock release mechanism may include an operating portion arranged to be operated manually at an outside of the swivel portion. The operating portion may be arranged such that an engagement of at least one pair of gears among the plurality of gears is released by performing a release operation.

Also, the operating portion may be arranged such that at least one of the plurality of gears is moved in a predetermined direction by the release operation. Or, the operating unit may be arranged such that the gear that has been moved by the release operation is moved in a direction opposite the predetermined direction by performing a return operation.

Also, the steering apparatus for a propulsion device may further include a transmission member and a manual steering portion. The transmission member may be provided in the transmission path at a downstream side relative to the lock release mechanism. The transmission member may be arranged to transmit force to a downstream side of the transmission member by being rotated. The manual steering portion may be arranged to rotate the transmission member by being operated manually in a state where the locking of the propulsion device main body by the lock portion is released.

Also, the steering apparatus for a propulsion device may further include a swivel shaft and a coupling member. The swivel shaft may be arranged along a turning axis of the propulsion device main body and may be arranged to be turned about the turning axis by the motor. The coupling member may be coupled to the propulsion device main body. The lock release mechanism may include a pin member detachably attached to the swivel shaft and the coupling member. The pin member may be arranged to couple the swivel shaft and the coupling member such that the swivel shaft and the coupling member turn integrally about the turning axis.

Also, the transmitting mechanism may include a pulley detachably coupled to the lock portion, and a belt attached to the pulley and arranged to transmit a force, which is transmitted to the pulley, to a downstream side of the transmission path. In this case, the lock release mechanism may be arranged to detach the pulley from the lock portion.

Also, the transmitting mechanism may include a sprocket detachably coupled to the lock portion, and a chain attached to the sprocket and arranged to transmit a force, which is transmitted to the sprocket, to a downstream side in the transmission path. In this case, the lock release mechanism may be arranged to detach the sprocket from the lock portion.

Also, a preferred embodiment of the present invention provides a steering apparatus for a propulsion device including a swivel portion, a motor, a lock portion, and a manual steering portion. The swivel portion is arranged to attach a propulsion device main body to a hull such that the propulsion device main body is capable of turning in right and left directions. The motor is provided at the swivel portion. The motor is arranged to generate a driving force to turn the propulsion device main body in the right and left directions. The lock portion is provided in a transmission path of the driving force. The lock portion is arranged to transmit a force from an upstream side to a downstream side of the lock portion and to be locked when a force is applied from the downstream side to thereby prevent turning of the propulsion device main body in the right and left directions. The manual steering portion is provided in the transmission path at an upstream side relative to the lock portion. The manual steering portion is arranged to be operated manually to apply a steering force, which is to turn the propulsion device main body in the right and left directions, to the transmission path.

By this arrangement, when a force that turns the propulsion device main body in the right and left directions (for example, a reaction force from water) is applied to the propulsion device main body, the force is transmitted to the lock portion. That is, the force applied to the propulsion device main body is applied to the lock portion from the downstream side. The lock portion thereby is locked and locks the turning of the propulsion device main body in the right and left directions. Thus, even if the motor is not driven during running of the hull, the turning of the propulsion device main body in the right and left directions is locked by the lock portion. The motor thus does not have to be driven constantly during the running of the hull. A load of the motor is thereby reduced. Further, when a user manually operates the manual steering portion, the steering force that turns the propulsion device main body in the right and left directions is applied to the transmission path. This steering force is applied at the upstream side relative to the lock portion and thus the lock portion is not locked by the application of the steering force. The steering force applied to the transmission path is thus transmitted to the propulsion device main body through the transmission path. The propulsion device main body is thereby turned manually in the right and left directions. The user can thus turn the propulsion device main body in the right and left directions without using the driving force of the motor.

Also, the motor may include a motor main body and a motor shaft protruding from the motor main body. In this case, the manual steering portion may include a rotating member integrally coupled to the motor shaft in an inside of the swivel portion. The rotating member may be arranged to be rotated from an outside of the swivel portion.

The motor shaft may include a first end portion protruding to the lock portion side from the motor main body. In this case, the rotating member may be coupled to the first end portion.

Also, the motor shaft may include a first end portion protruding to the lock portion side from the motor main body, and a second end portion protruding to an opposite side with respect to the lock portion from the motor main body. In this case, the rotating member may be coupled to the second end portion.

Also, the manual steering portion may be arranged inside of the swivel portion. In this case, the swivel portion may include an opening portion arranged to cause the inside of the swivel portion to communicate with an outside of the swivel portion and arranged at a position corresponding to the manual steering portion.

Also, the rotating member may include a driven gear integrally coupled to the motor shaft. In this case, the manual steering portion may include a drive gear engaged with the driven gear and arranged to be rotated manually.

The manual steering portion may include a tool engaging member arranged to rotate together with the drive gear about a rotation axis of the drive gear. The tool engaging member may include an engaging portion, which is to engage with a tool, and be arranged to be rotated about the rotation axis of the drive gear by the tool.

Also, a preferred embodiment of the present invention provides a propulsion device including a propulsion device main body, and a steering apparatus arranged to steer the propulsion device main body. The steering apparatus includes a swivel portion, a motor, a lock portion, and a lock release mechanism. The swivel portion is arranged to attach the propulsion device main body to a hull such that the propulsion device main body is capable of turning in right and left directions. The motor is provided at the swivel portion. The motor is arranged to generate a driving force to turn the propulsion device main body in the right and left directions. The lock portion is provided in a transmission path of the driving force. The lock portion is arranged to transmit a force from an upstream side to a downstream side of the lock portion and to be locked when a force is applied from the downstream side to thereby prevent turning of the propulsion device main body in the right and left directions. The lock release mechanism is provided in the transmission path at a downstream side relative to the lock portion. The lock release mechanism is arranged to shut off or stop a transmission of force to an upstream side of the lock release mechanism to thereby prevent application of the force to the lock portion.

Also, a preferred embodiment of the present invention provides a propulsion device including a propulsion device main body, and a steering apparatus arranged to steer the propulsion device main body. The steering apparatus includes a swivel portion, a motor, a lock portion, and a manual steering portion. The swivel portion is arranged to attach a propulsion device main body to a hull such that the propulsion device main body is capable of turning in right and left directions. The motor is provided at the swivel portion. The motor is arranged to generate a driving force to turn the propulsion device main body in the right and left directions. The lock portion is provided in a transmission path of the driving force. The lock portion is arranged to transmit a force from an upstream side to a downstream side of the lock portion and to be locked when a force is applied from the downstream side to thereby prevent turning of the propulsion device main body in the right and left directions. The manual steering portion is provided in the transmission path at an upstream side relative to the lock portion. The manual steering portion is arranged to be operated manually to apply a steering force, which turns the propulsion device main body in the right and left directions, to the transmission path.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

An outboard motor 3A according to a first preferred embodiment of the present invention shall now be described with reference to FIG. 1 to FIG. 7. First, an arrangement of the outboard motor 3A shall be described. FWD in the figures indicates a forward drive direction of a marine vessel 1.

Figure 1:
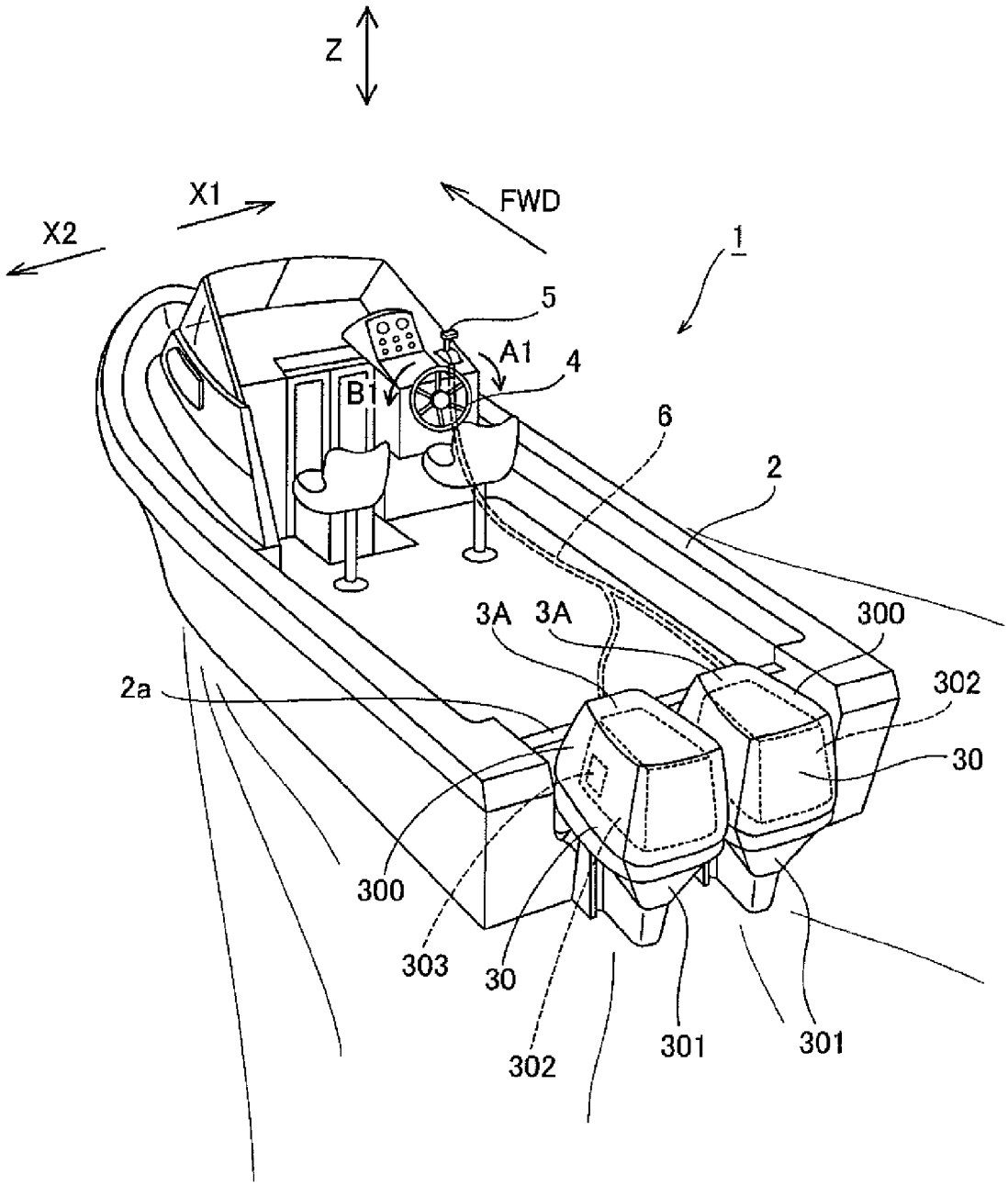
FIG. 1 is a perspective view of a marine vessel equipped with an outboard motor according to a first preferred embodiment of the present invention.

As shown in FIG. 1, the marine vessel 1 includes a hull 2 floating on a water surface, two outboard motors 3A attached to a rear portion of the hull 2, a steering portion 4 arranged to steer the hull 2, and a control lever 5 arranged in a vicinity of the steering portion 4. Each outboard motor 3A is an example of a "marine vessel propulsion device" according to a preferred embodiment of the present invention. The hull 2 is propelled by the two outboard motors 3A, although any number of outboard motors 3A can be provided to propel the hull 2. Switching between forward drive and reverse drive of the hull 2 is performed by the control lever 5. Each outboard motor main body 30 is turned in right and left directions (X1 arrow direction and X2 arrow direction) by operation of the steering portion 4. The hull 2 is thereby steered.

Also, a LAN (local area network) cable 6 electrically connects the respective outboard motors 3A with the steering portion 4 and the respective outboard motors 3A with the control lever 5. The LAN cable 6 transmits an electrical signal from the steering portion 4 to each outboard motor 3A (specifically, a driver 7 arranged inside a swivel bracket 31 (see FIG. 5)). Also, the LAN cable 6 also transmits an electrical signal from the control lever 5 to each outboard motor 3A (specifically, an ECU 303 arranged inside an outboard motor main body 30 (see FIG. 1)). Each ECU (engine control unit) 303 is electrically connected to an engine 302 of an outboard motor 3A. Each ECU 303 controls the engine 302 based on operation of the control lever 5.

Figure 2:
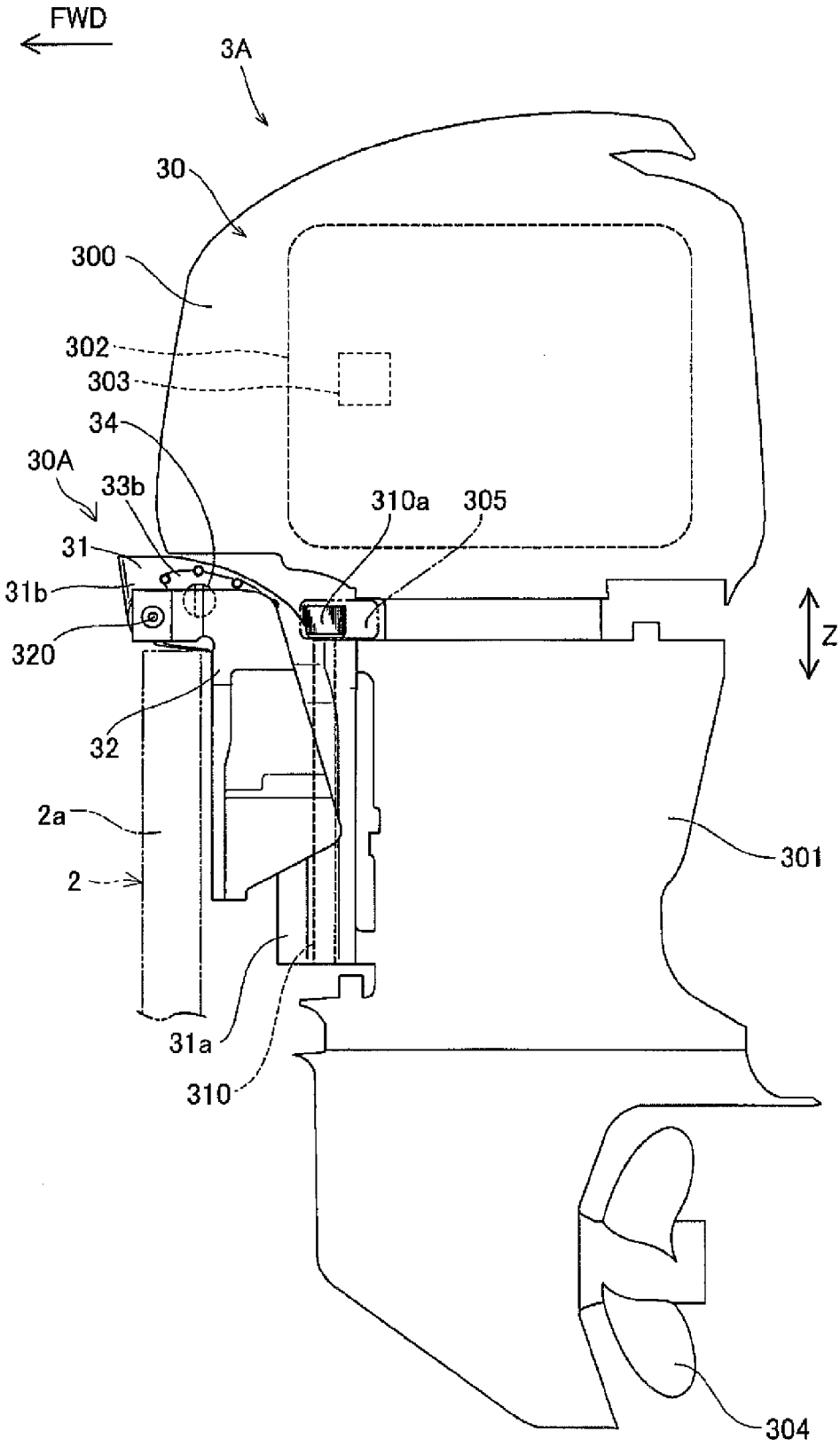
FIG. 2 is a side view of an overall arrangement of the outboard motor according to the first preferred embodiment of the present invention.

As shown in FIG. 2, the outboard motor 3A includes the outboard motor main body 30, and a steering apparatus 30A arranged to steer the outboard motor main body 30. The steering apparatus 30A includes a swivel bracket 31, and a tilt bracket 32. The outboard motor main body 30 is an example of a "propulsion device main body" according to a preferred embodiment of the present invention. Also, the swivel bracket 31 is an example of a "swivel portion" according to a preferred embodiment of the present invention. The outboard motor main body 30 is attached to the swivel bracket 31. Also, the swivel bracket 31 is attached to the tilt bracket 32. The tilt bracket 32 is fixed to a stern plate 2*a* provided at a rear portion of the hull 2. The outboard motor main body 30 is thus attached to the hull 2 via the swivel bracket 31 and the tilt bracket 32.

The outboard motor main body 30 is coupled to the swivel bracket 31 in a manner enabling turning in the right and left directions about a swivel shaft 310 that extends in a vertical direction. Also, the swivel bracket 31 is coupled to the tilt bracket 32 in a manner enabling turning in up and down directions (Z direction) about a tilt shaft 320 extending in a width direction (X1 arrow direction and X2 arrow direction in FIG. 1) of the hull 2. The outboard motor main body 30 is thus held with respect to the hull 2 in a manner enabling turning in the right and left directions about the swivel shaft 310. The outboard motor main body 30 is also held with respect to the hull 2 in a manner enabling turning in the up and down directions about the tilt shaft 320.

As shown in FIG. 2, the swivel shaft 310 includes a spline portion 310*a* provided at an upper portion of the swivel shaft 310. A coupling member 305 coupled to the outboard motor main body 30 is attached to the spline portion 310*a*. The outboard motor main body 30 and the coupling member 305 are arranged to be turned together with the swivel shaft 310.

Also, as shown in FIG. 2, the outboard motor main body 30 includes an engine cover 300 provided at an upper portion of the outboard motor main body 30, and a case 301 provided below the engine cover 300. The engine 302 and the ECU 303 are housed inside the engine cover 300. Also, a propeller 304 is provided at a lower portion of the case 301. The propeller 304 is driven to rotate by the engine 302.

Next, a structure of the swivel bracket 31 according to the first preferred embodiment shall now be described in detail.

As shown in FIG. 2, the swivel bracket 31 includes a swivel shaft holding portion 31*a*, and a turning mechanism housing portion 31*b*. The swivel shaft holding portion 31*a* is arranged to extend in the up/down direction. The swivel shaft 310 is held by the swivel shaft holding portion 31*a* in a state of being arranged along the up/down direction. An upper portion of the swivel shaft 310 is arranged inside of the turning mechanism housing portion 31*b*. As show in FIG. 3, a turning mechanism 311 that is arranged to turn the swivel shaft 310 is arranged inside of the turning mechanism housing portion 31*b*.

Figure 3:
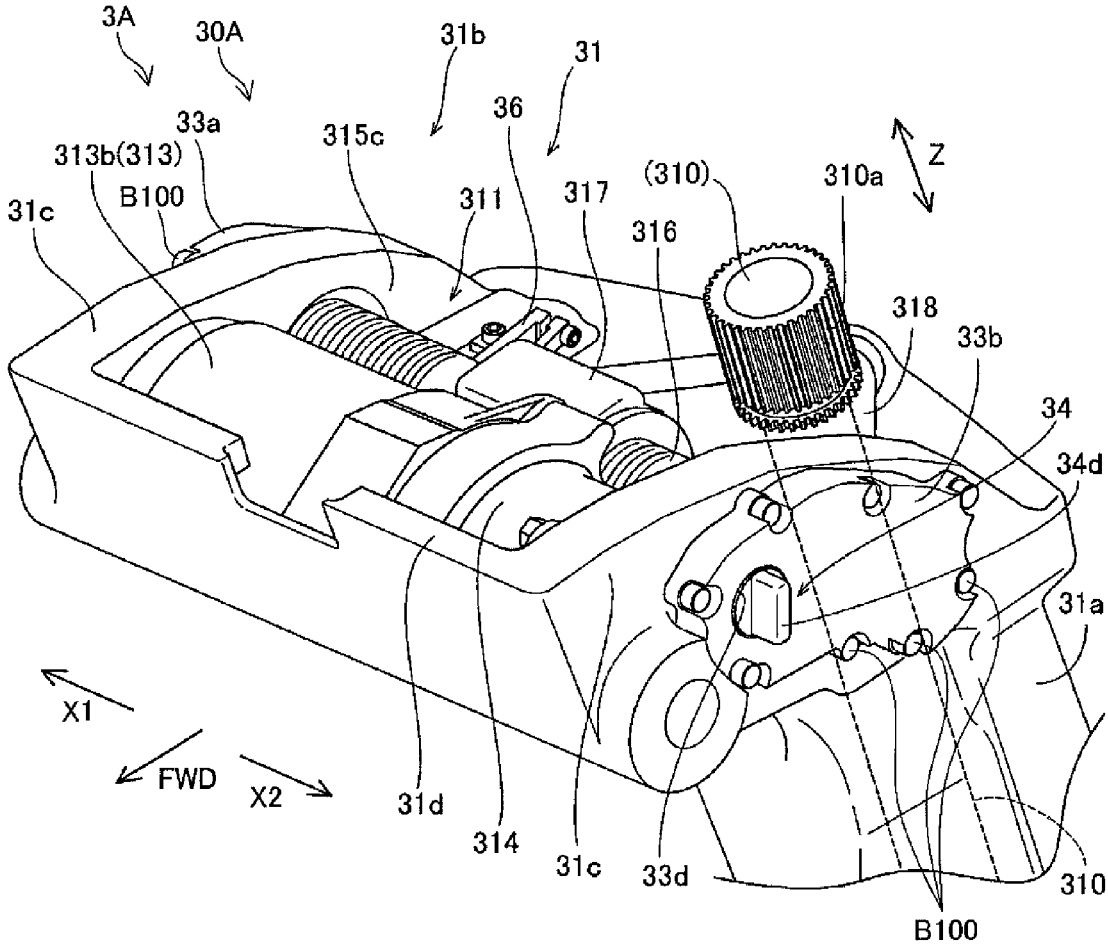
FIG. 3 is a perspective view for explaining an arrangement of a swivel bracket according to the first preferred embodiment of the present invention.
Figure 4:
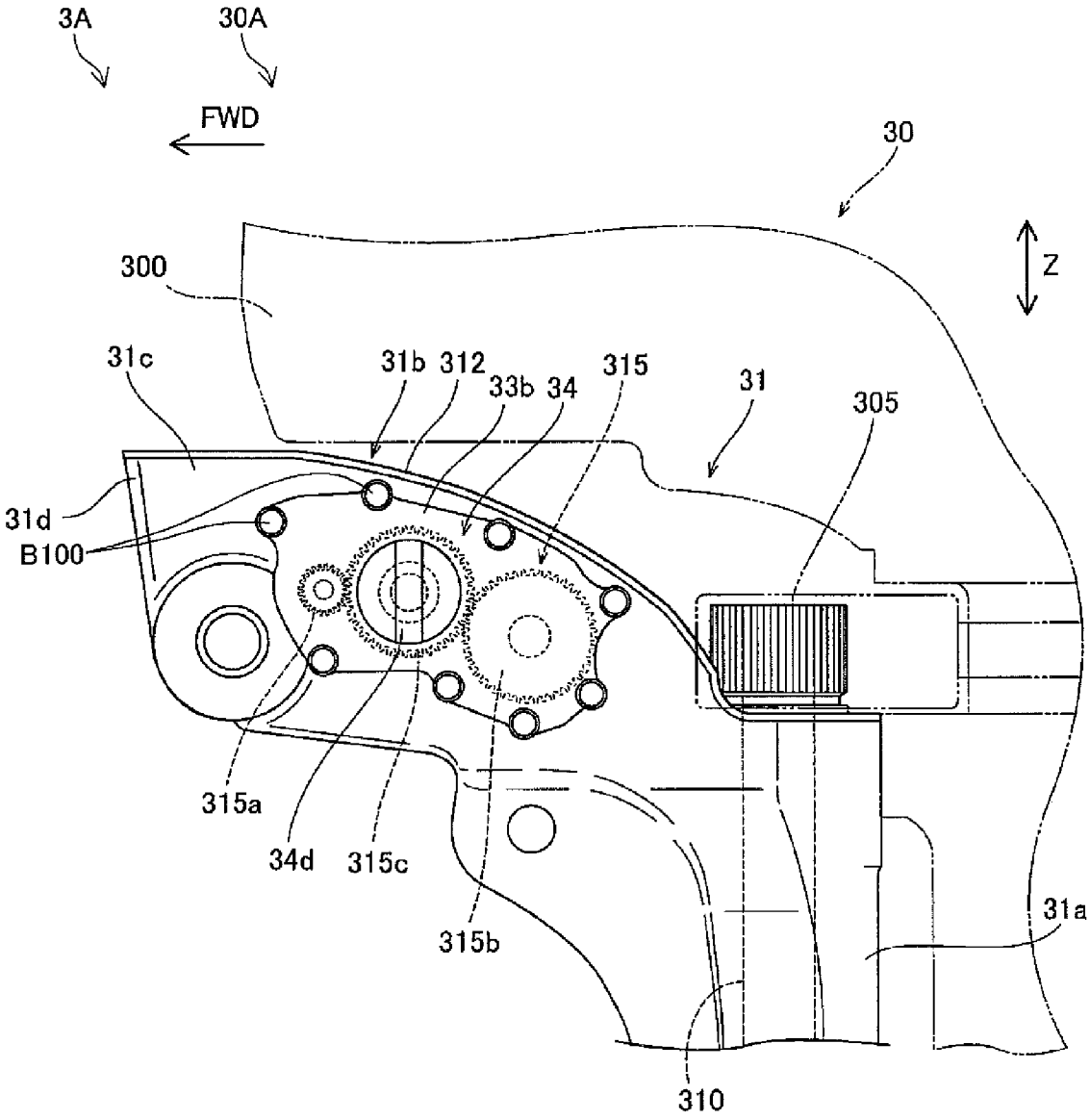
FIG. 4 is a side view for explaining the arrangement of the swivel bracket according to the first preferred embodiment of the present invention.

As shown in FIG. 4, the turning mechanism housing portion 31*b* is coupled to an upper portion of the swivel shaft holding portion 31*a*. The turning mechanism housing portion 31*b* is arranged to protrude forward (in a FWD arrow direction) from an upper portion of the swivel shaft holding portion 31*a*. As shown in FIG. 3, the turning mechanism housing portion 31*b* includes a pair of side wall portions 31*c* arranged to extend forward from the upper portion of the swivel shaft holding portion 31*a*, and a front wall portion 31*d* connecting front portions of the pair of side wall portions 31*c*. The turning mechanism housing portion 31*b* has a shape of a box that is opened at an upper portion. As shown in FIG. 4, a cover member 312 is attached to the upper portion of the turning mechanism housing portion 31*b*. The cover member 312 covers an entirety of the opening of the turning mechanism housing portion 31*b*. The inside of the turning mechanism housing portion 31*b* is thereby sealed.

Also, as shown in FIG. 3, the pair of side wall portions 31*c* are arranged in parallel or substantially in parallel across an interval in the width direction (X1 arrow direction and X2 arrow direction) of the hull 2. A plate member 33*a* is detachably attached, for example, by a plurality of bolts B100, for example, to the side wall portion 31*c* arranged at the X1 arrow direction side. Also, a plate member 33*b* is detachably attached, for example, by a plurality of bolts B100, for example, to the side wall portion 31*c* arranged at the X2 arrow direction side. The plate member 33*a* covers an outer surface of the side wall portion 31*c* at the X1 arrow direction side. Also, the plate member 33*b* covers an outer surface of the side wall portion 31*c* at the X2 arrow direction side.

Figure 5:
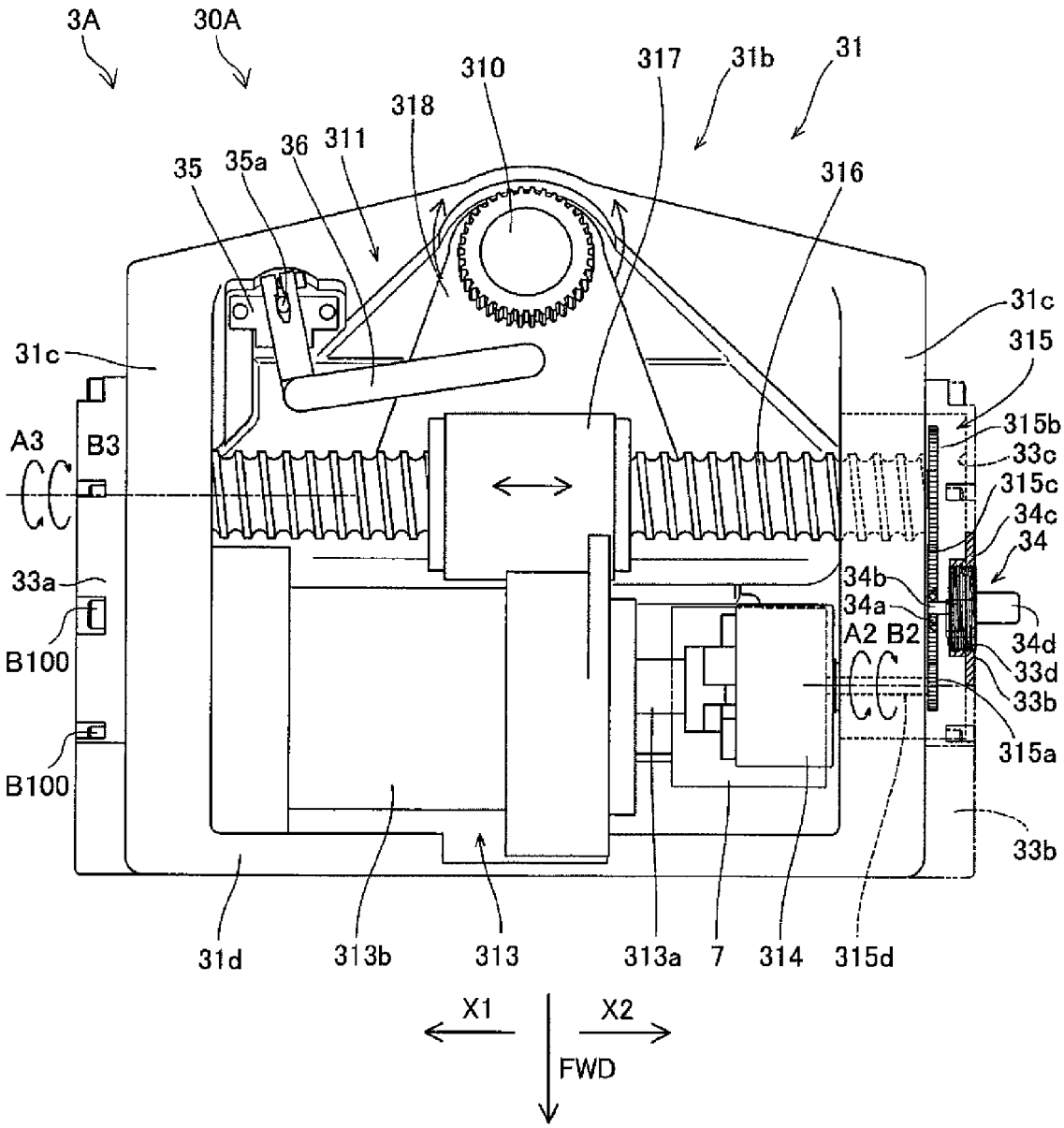
FIG. 5 is a plan view for explaining the arrangement of the swivel bracket according to the first preferred embodiment of the present invention.

Also, as shown in FIG. 5, the turning mechanism 311 includes a motor 313 including a motor shaft 313*a*, a lock clutch 314, and a gear mechanism 315. The motor 313 generates a driving force to turn the outboard motor main body 30 (see FIG. 2) in the right and left directions. The motor shaft 313*a* of the motor 313 is driven to rotate by electricity. The lock clutch 314 is coupled to the motor shaft 313*a*. The gear mechanism 315 is coupled to the lock clutch 314. The lock clutch 314 is an example of a "lock portion" according to a preferred embodiment of the present invention.

Also, as shown in FIG. 5, the turning mechanism 311 further includes a ball screw 316, a ball nut 317 attached to the ball screw 316, and a transmission plate 318 coupled to the ball nut 317. The ball screw 316 is an example of a "transmission member" according to a preferred embodiment of the present invention. The ball screw 316 is arranged along the width direction of the hull 2. Rotation of the motor shaft 313*a* is transmitted to the ball screw 316 via the lock clutch 314 and the gear mechanism 315. Also, the rotation of the ball screw 316 is converted to movement of the ball nut 317 in the width direction of the hull 2. The transmission plate 318 is arranged to be turned about the swivel shaft 310 in accordance with the movement of the ball nut 317.

As shown in FIG. 5, the motor 313 is housed in the turning mechanism housing portion 31*b*. The motor 313 is arranged along an inner surface of the front wall portion 31*d*. The lock clutch 314 is arranged between the motor 313 and the side wall portion 31*c* at the X2 arrow direction side. The motor 313 includes the motor shaft 313*a*, and a motor main body 313*b*. The motor shaft 313*a* is arranged along the width direction of the hull 2. The motor shaft 313*a* is arranged to protrude in the width direction of the hull 2 from the motor main body 313*b*. The motor shaft 313*a* includes a first end portion protruding to the lock clutch 314 side from the motor main body 313*b*.

Also, as shown in FIG. 5, the motor 313 is electrically connected to the driver 7. The driver 7 is arranged to control the motor 313 based on the signal transmitted from the steering portion 4 (see FIG. 1) via the LAN cable 6 (see FIG. 1). Specifically, when the steering portion 4 is rotated in an A1 direction (see FIG. 1), the driver 7 controls the motor 313 to rotate the motor shaft 313*a* in an A2 direction (see FIG. 5).

Also, when the steering portion 4 is rotated in a B1 direction (see FIG. 1), the driver 7 controls the motor 313 to rotate the motor shaft 313*a* in a B2 direction (see FIG. 5).

Also, the lock clutch 314 is arranged in a driving force transmission path leading from the motor 313 to the outboard motor main body 30. The lock clutch 314 is arranged to transmit a force from an upstream side of the transmission path to a downstream side of the transmission path and be locked when a force is applied from the downstream side to thereby prevent transmission of the force to the upstream side. The lock clutch 314 is, for example, a reverse input shutoff clutch (for example, Torque Diode®, made by NTN Corporation). The lock clutch 314 has a mechanical structure including a ratchet mechanism (not shown), etc., arranged in an inside of the lock clutch 314. The rotation of the motor 313 is transmitted to the lock clutch 314. That is, the driving force of the motor 313 is applied from the upstream side to the lock clutch 314. The rotation applied to the lock clutch 314 from the motor 313 is thus transmitted to the gear mechanism 315.

Meanwhile, for example, during running of the hull 2, the outboard motor main body 30 is pushed by water and a force (reaction force) to turn the outboard motor main body 30 in the right and left directions is applied to the outboard motor main body 30. This force is applied to the lock clutch 314 via the gear mechanism 315. That is, the force applied to the outboard motor main body 30 is transmitted to the lock clutch 314 from the downstream side. Thus, in this case, the lock clutch 314 locks and the rotation of the gear mechanism 315 is prevented. Turning of the outboard motor main body 30 in the right and left directions is thereby locked. Thus, even if the motor 313 is not driven during the running of the hull 2, the turning of the outboard motor main body 30 in the right and left directions is locked by the lock clutch 314. The motor 313 thus does not have to be driven constantly during the running of the hull 2.

The gear mechanism 315 is provided at the downstream side relative to the lock clutch 314. The gear mechanism 315 is arranged to transmit the driving force of the motor 313 to the downstream side. As shown in FIG. 4, the gear mechanism 315 includes an input gear 315*a*, an output gear 315*b*, and an intermediate gear 315*c* engaged with the input gear 315*a* and the output gear 315*b*. The input gear 315*a*, the output gear 315*b*, and the intermediate gear 315*c* are, for example, spur gears, respectively. As shown in FIG. 5, the input gear 315*a*, the output gear 315*b*, and the intermediate gear 315*c* are arranged along an outer surface of the side wall portion 31*c* at the X2 arrow direction side. The gear mechanism 315 is housed in a hollow portion 33*c* provided in the plate member 33*b*. The gear mechanism 315 is covered by the plate member 33*b*.

Figure 6:
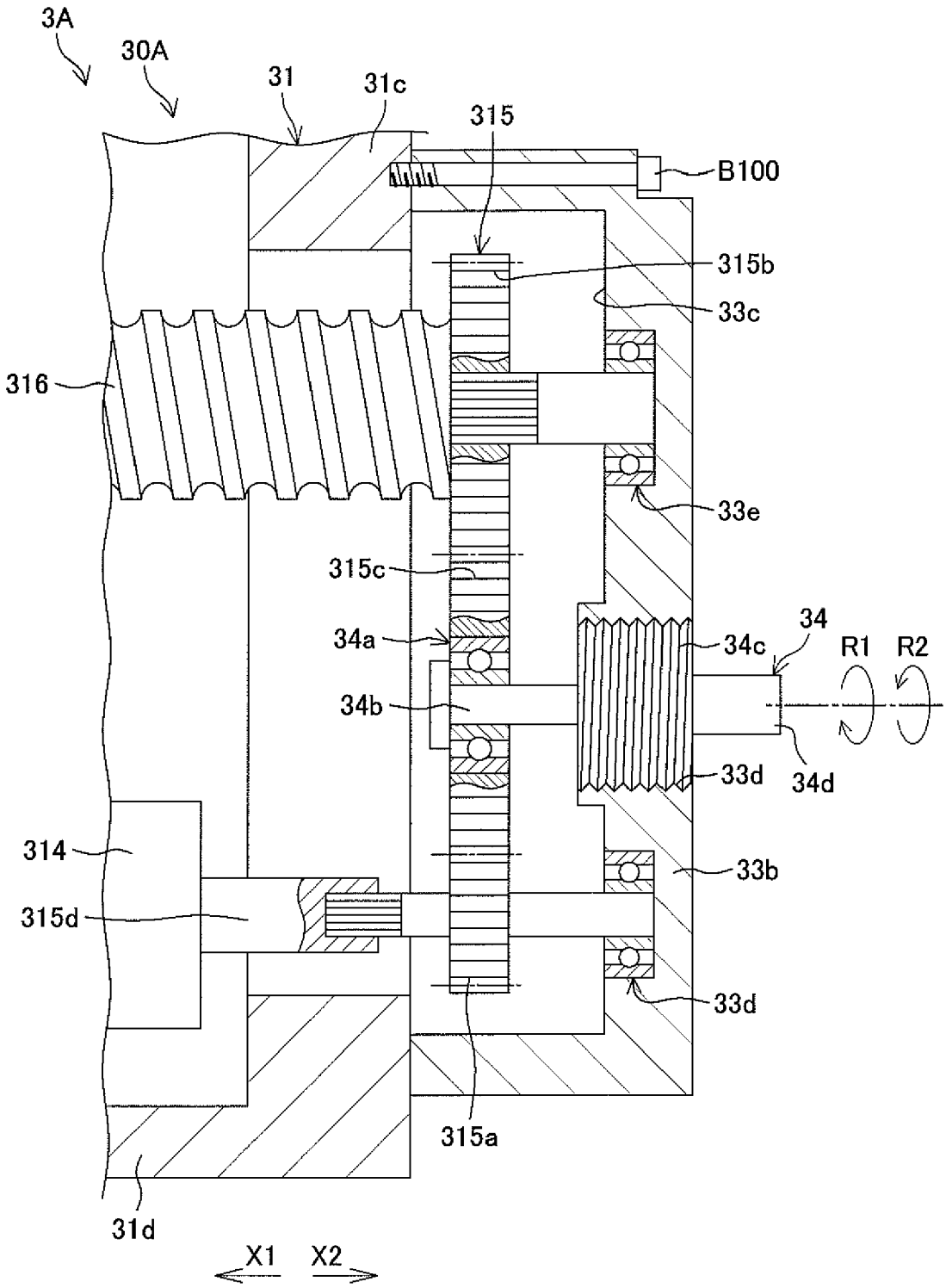
FIG. 6 is a sectional view for explaining an arrangement of a vicinity of an operating portion of the swivel bracket according to the first preferred embodiment of the present invention.

As shown in FIG. 6, the input gear 315*a* is held by the plate member 33*b* via a bearing 33*d*. The input gear 315*a* is detachably coupled to a shaft member 315*d* that protrudes from the lock clutch 314. The input gear 315*a* is arranged to rotate together with the shaft member 315*d*. The coupling of the input gear 315*a* and the shaft member 315*d* may be achieved by a spline engagement as shown in FIG. 6 or by joining by engagement of a key and a key groove, for example.

Also, as shown in FIG. 6, the output gear 315*b* is detachably coupled to the ball screw 316. The output gear 315*b* is arranged to rotate together with the ball screw 316. As shown in FIG. 6, an end portion of the ball screw 316 is fitted in an inner periphery of a bearing 33*e* held by the plate member 33*b*. The coupling of the output gear 315*b* and the ball screw 316 may be achieved by a spline engagement as shown in FIG. 6 or by joining by engagement of a key and a key groove, for example.

Also, as shown in FIG. 6, the intermediate gear 315*c* is held by the plate member 33*b* via an operating portion 34. The operating portion 34 is an example of a "lock release mechanism" according to a preferred embodiment of the present invention. The rotation of the input gear 315*a* is transmitted to the output gear 315*b* via the intermediate gear 315*c*. Thus, the driving force of the motor 313, applied to the input gear 315*a* via the lock clutch 314 and the shaft member 315*d*, is transmitted to the output gear 315*b* via the intermediate gear 315*c*. Then, the driving force transmitted to the output gear 315*b* is output to the ball screw 316.

The intermediate gear 315*c* is arranged to move between an engaged position (position shown in FIG. 5 and FIG. 6) and a disengaged position (position shown in FIG. 7) by operation of the operating portion 34. The engaged position is the position at which the intermediate gear 315*c* is engaged with the input gear 315*a* and the output gear 315*b*. Also, the disengaged position is the position at which the engagement of the intermediate gear 315*c* with the input gear 315*a* and the output gear 315*b* is released.

By the intermediate gear 315*c* being positioned at the disengaged position, the transmission of force by the gear mechanism 315 is stopped. Thus, in the state where the intermediate gear 315*c* is arranged at the disengaged position, even if a force that turns the outboard motor main body 30 in the right and left directions is applied to the outboard motor main body 30, this force is not transmitted to the lock clutch 314. Thus, in this state, the turning of the outboard motor main body 30 in the right and left directions is not locked by the lock clutch 314. Thus, for example, when a user manually pushes the outboard motor main body 30 in the right and left directions in this state, the outboard motor main body 30 turns in the right and left directions.

As shown in FIG. 6, the operating portion 34 includes a bearing 34*a*, a rotating shaft 34*b*, and a handle portion 34*d*. The bearing 34*a* is fitted in a bearing holding hole provided in a central portion of the intermediate gear 315*c*. The bearing 34*a* is coupled to the intermediate gear 315*c*, for example, by press fitting. Also, the rotating shaft 34*b* is fitted in an inner periphery of the bearing 34*a*. The rotating shaft 34*b* is coupled to the bearing 34*a*, for example, by press fitting. The rotating shaft 34*b* is coupled to the handle portion 34*d*. The handle portion 34*d* includes a threaded portion 34*c* coupled coaxially to the rotating shaft 34*b*. The threaded portion 34*c* is attached to a threaded hole 33*d* provided in the plate member 33*b*. The operating portion 34 is held by the plate member 33*b* by engagement of the threaded portion 34*c* and the threaded hole 33*d*.

Figure 7:
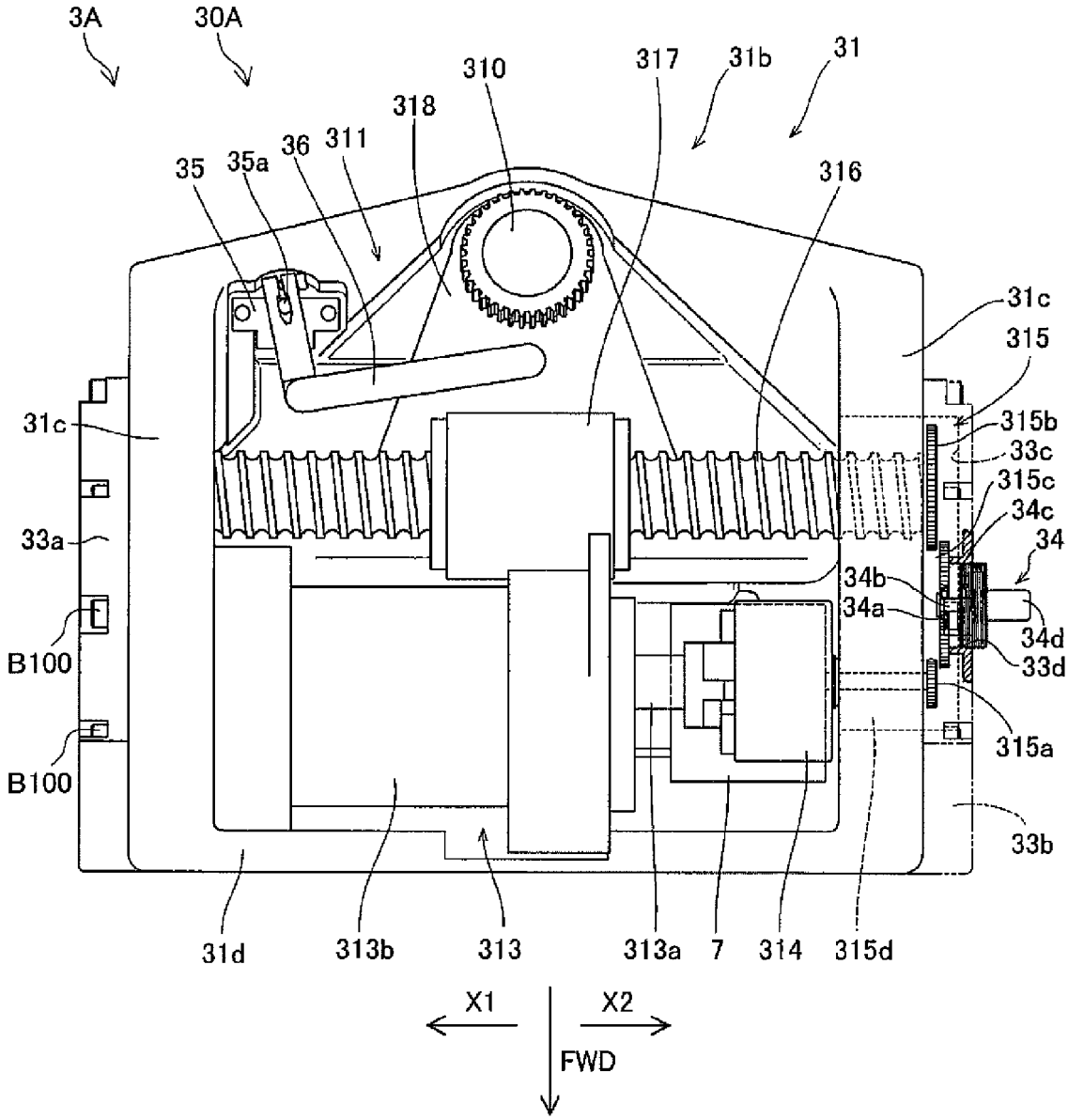
FIG. 7 is a plan view for explaining the arrangement of the swivel bracket according to the first preferred embodiment of the present invention.

As shown in FIG. 6, the handle portion 34*d* is arranged to be operated manually by the user from an outside of the swivel bracket 31 and the plate member 33*b*. When the handle portion 34*d* is operated by the user, the handle portion 34*d* rotates about the rotating shaft 34*b* in an R1 direction or an R2 direction. Also, in accordance with the rotation of the handle portion 34*d* in the R1 direction or the R2 direction, the intermediate gear 315*c* moves in an axial direction (X1 arrow direction or X2 arrow direction) of the intermediate gear 315*c*. When a release operation is performed in the state where the intermediate gear 315*c* is positioned at the engaged position, the intermediate gear 315*c* moves in the X2 arrow direction and is positioned at the disengaged position. The engagement of the intermediate gear 315*c* with the input gear 315*a* and the output gear 315*b* is thereby released as shown in FIG. 7. When a return operation is performed when the intermediate gear 315*c* is at the disengaged position, the intermediate gear 315*c* moves in the X1 arrow direction and is positioned at the engaged position again. The intermediate gear 315*c* is thereby engaged again with the input gear 315*a* and the output gear 315*b*.

The rotation of the motor shaft 313*a* is transmitted to the ball screw 316 via the gear mechanism 315. The ball nut 317 is arranged to move in the X1 arrow direction or the X2 arrow direction in accordance with the rotation of the ball screw 316. Specifically, when the motor shaft 313*a* is rotated in the A2 direction (see FIG. 5), the ball screw 316 is rotated in an A3 direction (see FIG. 5). The ball nut 317 is arranged to move in the X1 arrow direction in accordance with the rotation of the ball screw 316 in the A3 direction. Also, when the motor shaft 313*a* is rotated in the B2 direction (see FIG. 5), the ball screw 316 is rotated in a B3 direction (see FIG. 5). The ball nut 317 is arranged to move in the X2 arrow direction in accordance with the rotation of the ball screw 316 in the B3 direction.

The ball nut 317 is coupled to the transmission plate 318. Also, the transmission plate 318 is coupled to the swivel shaft 310. The transmission plate 318 is arranged to be turned in the right and left directions about the swivel shaft 310 in accordance with the movement of the ball nut 317 in the X1 axis direction or the X2 axis direction. Also, the swivel shaft 310 is arranged to be turned in accordance with the turning of the transmission plate 318. A turning amount of the transmission plate 318 is computed based on a detection value of a turning sensor 35 (see FIG. 5) arranged at the X1 arrow direction side of the transmission plate 318.

As shown in FIG. 5, the turning sensor 35 includes a turning shaft 35*a* arranged at the X1 arrow direction side of the transmission plate 318. The turning sensor 35 is coupled by a link member 36 to the transmission plate 318. The link member 36 is arranged to move in accordance with the turning of the transmission plate 318 about the swivel shaft 310. Also, the turning shaft 35*a* is arranged to rotate in accordance with the movement of the link member 36. The turning amount of the transmission plate 318 is computed based on a turning amount of the turning shaft 35*a* by a computing mechanism that includes the ECU 303 (see FIG. 1).

A procedure for releasing the locking of the outboard motor main body 30 by the lock clutch 314 shall now be described.

As shown in FIG. 6, when the user manually rotates the handle portion 34*d* of the operating portion 34 in the R1 direction, the threaded portion 34*c* of the operating portion 34 rotates in the R1 direction with respect to the threaded hole 33*d* of the plate member 33*b*. The operating portion 34 thereby moves in the X2 arrow direction. Also, at this time, the bearing 34*a* and the rotating shaft 34*b* move in the X2 arrow direction together with the handle portion 34*d*. The bearing 34*a* is coupled to the intermediate gear 315*c*, and the intermediate gear 315*c* thus moves in the X2 arrow direction in accordance with the movement of the bearing 34*a* in the X2 arrow direction. The engagement of the intermediate gear 315*c* with the input gear 315*a* and the output gear 315*b* is thereby disengaged as shown in FIG. 7. Consequently, constraint of members, arranged at the downstream side relative to the intermediate gear 315*c*, by the lock clutch 314 is eliminated. Thus, when the user pushes the outboard motor main body 30 in the right and left directions in this state, the outboard motor main body 30 turns in the right and left directions.

Next, a procedure by which the lock that has been made ineffective is made effective again shall now be described.

As shown in FIG. 6, when the user manually rotates the handle portion 34*d* of the operating portion 34 in the R2 direction, the threaded portion 34*c* of the operating portion 34 rotates in the R2 direction with respect to the threaded hole 33*d* of the plate member 33*b*. The operating portion 34 thereby moves in the X1 arrow direction. Also, at the same time, the bearing 34*a* and the rotating shaft 34*b* move together with the handle portion 34*d* in the X1 arrow direction. The bearing 34*a* is coupled to the intermediate gear 315*c*, and thus the intermediate gear 315*c* moves in the X1 arrow direction in accordance with the movement of the bearing 34*a* in the X1 arrow direction. The intermediate gear 315*c* thereby engages again with the input gear 315*a* and the output gear 315*b* as shown in FIG. 6. Consequently, the members arranged at the downstream side relative to the intermediate gear 315*c* are constrained again by the lock clutch 314. The turning of the outboard motor main body 30 in the right and left directions is thus locked by the lock clutch 314.

Next, examples of technical effects and merits of the outboard motor 3A according to the first preferred embodiment of the present invention shall now be described.

With the first preferred embodiment, when a force (for example, a reaction force from water) that turns the outboard motor main body 30 in the right and left directions is applied to the outboard motor main body 30, the force is transmitted to the lock clutch 314. That is, the force applied to the outboard motor main body 30 is applied to the lock clutch 314 from the downstream side. The lock clutch 314 is thereby locked and locks the turning of the outboard motor main body 30 in the right and left directions. Thus, even if the motor 313 is not driven during running of the hull 2, the turning of the outboard motor main body 30 in the right and left directions is locked by the lock clutch 314. The motor 313 thus does not have to be driven constantly during the running of the hull 2. A load of the motor 313 is thereby reduced. Further, the locking of the outboard motor main body 30 by the lock clutch 314 is released by the operation of the operating portion 34. The user can thus release the locking of the outboard motor main body 30 by the lock clutch 314 and, for example, push the outboard motor main body 30 to turn the outboard motor main body 30 in the right and left directions.

Also, with the first preferred embodiment, the gear mechanism 315 includes the input gear 315*a*, the output gear 315*b*, and the intermediate gear 315*c*. The input gear 315*a* is coupled to the shaft member 315*d* that protrudes from the lock clutch 314. Also, the output gear 315*b* is coupled to the ball screw 316. That is, the input gear 315*a* and the output gear 315*b* are coupled to members that are fixed to the swivel bracket 31. The intermediate gear 315*c* can thus be moved easily in comparison to the input gear 315*a* and the output gear 315*b*. Thus, in comparison to the case where the input gear 315*a* or the output gear 315*b* is moved, the engagement of the intermediate gear 315*c* and the input gear 315*a* and the engagement of the intermediate gear 315*c* and the output gear 315*b* are released readily.

Also, with the first preferred embodiment, the operating portion 34 is arranged to be operated manually. Thus, a tool is not required for the user to operate the operating portion 34. High convenience is thus provided.

Second Preferred Embodiment

An outboard motor 3B according to a second preferred embodiment of the present invention shall now be described with reference to FIG. 8 to FIG. 10. First, an arrangement of the outboard motor 3B shall be described in detail.

Figure 8:
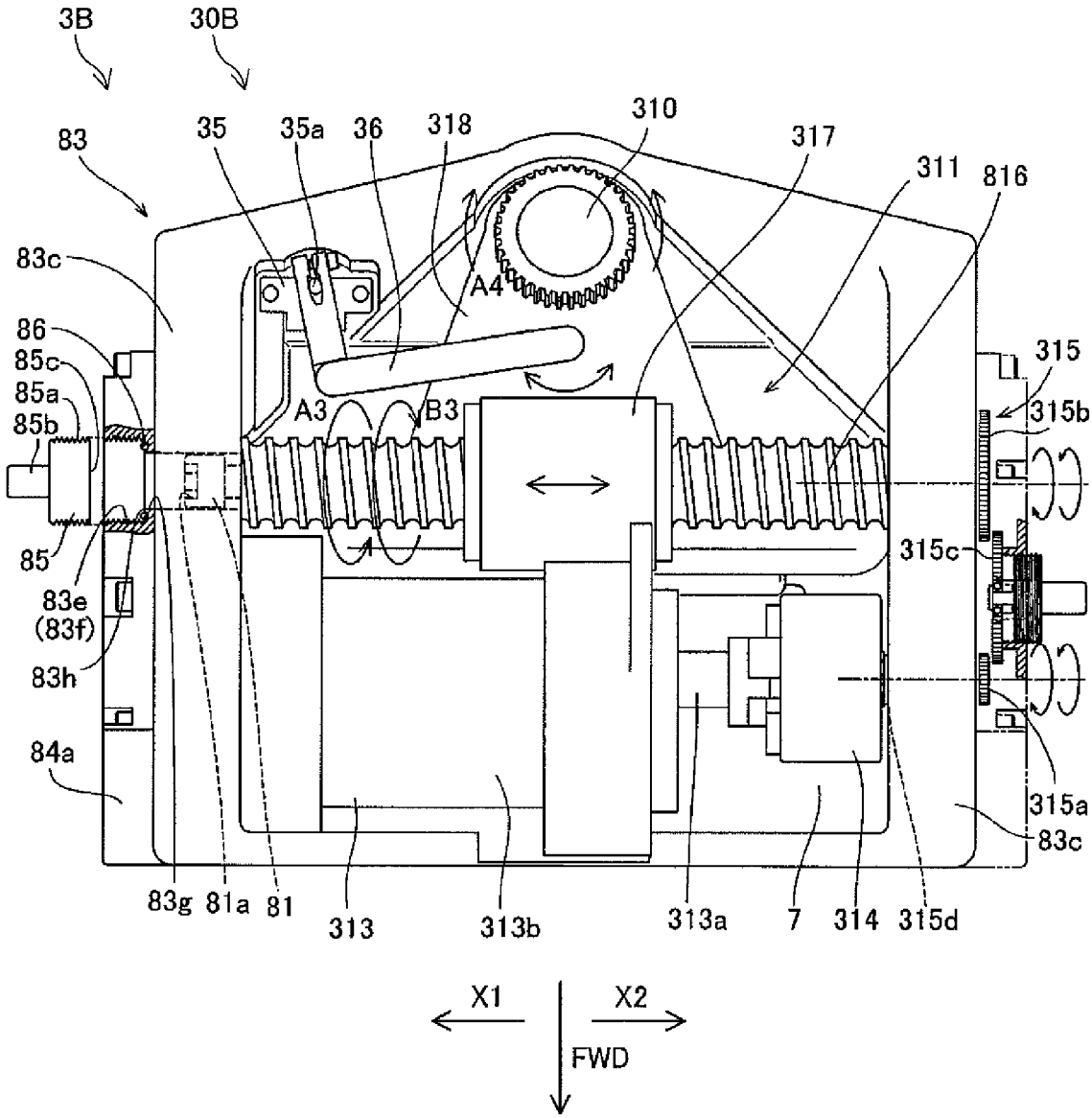
FIG. 8 is a plan view for explaining an arrangement of a swivel bracket according to a second preferred embodiment of the present invention.
Figure 9:
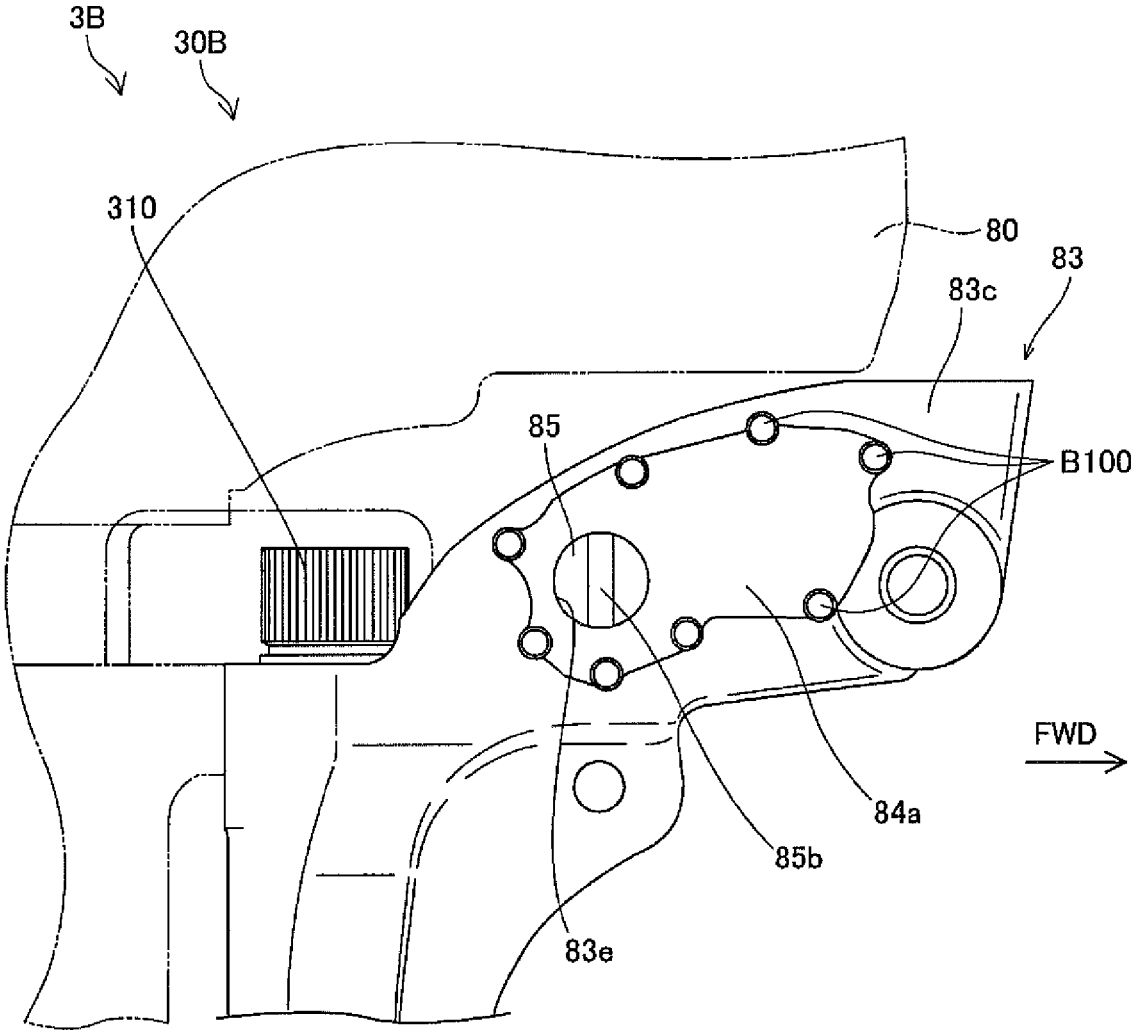
FIG. 9 is a side view for explaining the arrangement of the swivel bracket according to the second preferred embodiment of the present invention.

As shown in FIG. 9, the outboard motor 3B includes an outboard motor main body 80, and a steering apparatus 30B arranged to steer the outboard motor main body 80. The outboard motor main body 80 is an example of the "propulsion device main body" according to a preferred embodiment of the present invention. As shown in FIG. 8, the steering apparatus 30B includes a swivel bracket 83, and a rotating member 81 coupled coaxially to an end portion of a ball screw 816 at the X1 arrow direction side. The swivel bracket 83 is an example of the "swivel portion" according to a preferred embodiment of the present invention. Also, the rotating member 81 is an example of a "manual steering portion" according to a preferred embodiment of the present invention.

Figure 10:
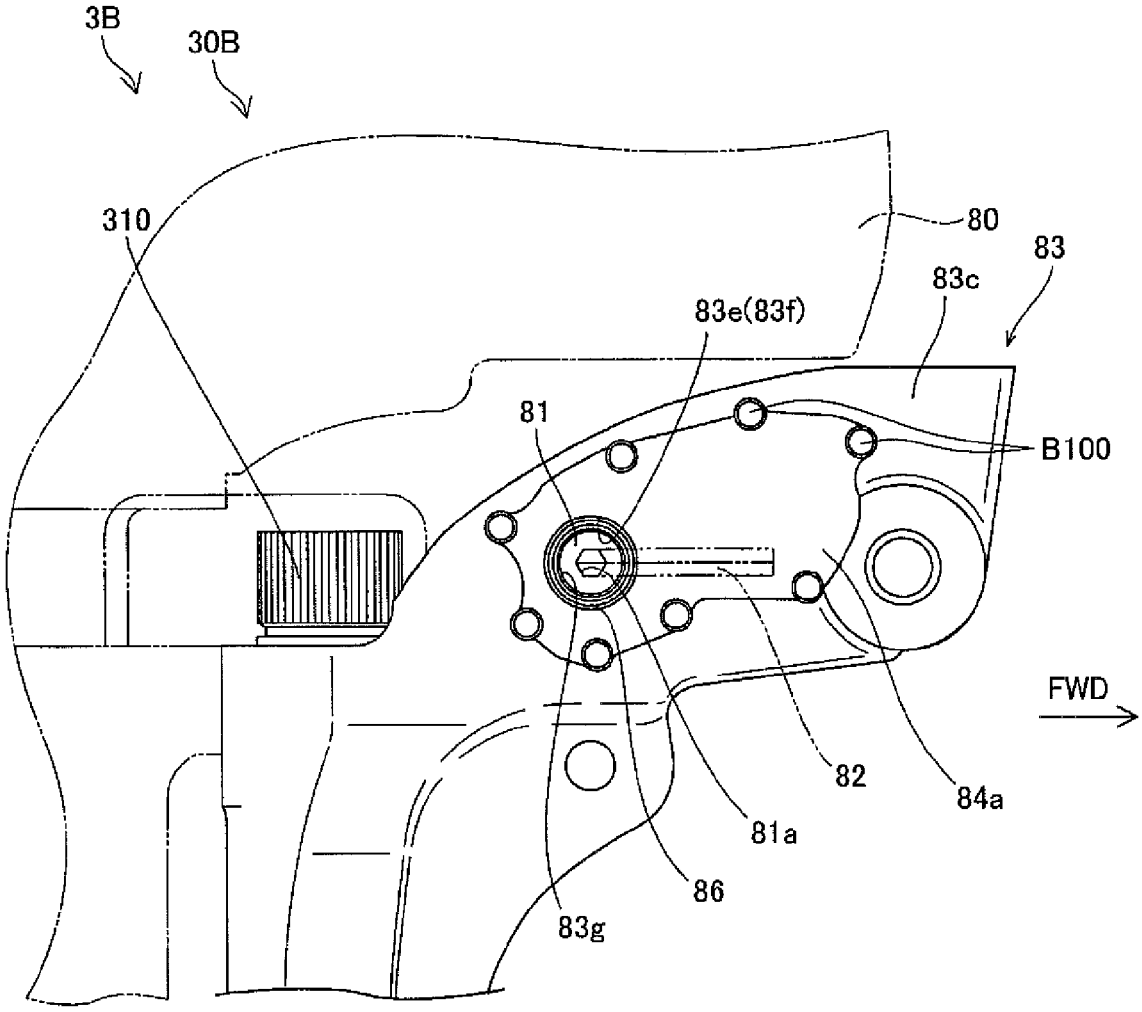
FIG. 10 is a side view for explaining the arrangement of the swivel bracket according to the second preferred embodiment of the present invention.

As shown in FIG. 10, the rotating member 81 includes a hexagonal hole 81*a* provided at an end portion of the rotating member 81 at the X1 arrow direction side. The user attaches a hexagonal wrench 82 (see FIG. 10) to the hexagonal hole 81*a*. The rotating member 81 is rotated by the hexagonal wrench 82, attached to the hexagonal hole 81*a*, being rotated by the user. Also, the ball screw 816 is rotated in accordance with the rotation of the rotating member 81. The user can thus rotate the ball screw 816 by rotating the rotating member 81 using the hexagonal wrench 82.

Also, as shown in FIG. 8, an opening portion 83*e* that penetrates through a side wall portion 83*c* at the X1 arrow direction side and a plate member 84*a* in the width direction of the hull 2 is provided in the swivel bracket 83 and the plate member 84*a*. The rotating member 81 is arranged inside the opening portion 83*e*. Also, as shown in FIG. 9, the opening portion 83*e* is closed by a lid member 85. The lid member 85 is arranged to be detachable with respect to the plate member 84*a*.

As shown in FIG. 8, the opening portion 83*e* includes a threaded portion 83*f* in which a thread is provided, a hole portion 83*g* having a smaller diameter than the threaded portion 83*f*, and a step portion 83*h* provided between the threaded portion 83*f* and the hole portion 83*g*. Also, the lid member 85 includes a threaded portion 85*a* corresponding to the threaded portion 83*f* of the opening portion 83*e*, and a knob portion 85*b* arranged to be held by the user. The lid member 85 is detached from the opening portion 83*e* by the knob portion 85*b* being held and rotated by the user. The hexagonal wrench 82 is inserted from an outside of the swivel bracket 83 and the plate member 84*a* into the opening portion 83*e* in a state where the lid member 85 is detached. The hexagonal wrench 82 is thereby attached to the hexagonal hole 81*a*.

Also, as shown in FIG. 8, an O-ring 86 that seals the interval between the lid member 85 and the opening portion 83*e* is provided at the step portion 83*h* of the opening portion 83*e*. The O-ring 86 is arranged so as to be sandwiched by a bottom portion 85*c* of the lid member 85 and the step portion 83*h* when the lid member 85 is attached to the threaded portion 83*f*. The swivel bracket 83 has an excellent sealing property.

Other structures of the second preferred embodiment are the same as those of the first preferred embodiment.

Next, an operation during manual turning of the outboard motor main body 80 in the right and left directions by the user in a state where the locking of the outboard motor main body 80 by the lock clutch 314 is made ineffective shall now be described.

As shown in FIG. 10, the hexagonal wrench 82 is inserted into the opening portion 83*e* in the state where the lid member 85 is detached from the opening portion 83*e*. An end portion of the hexagonal wrench 82 is then fitted into the hexagonal hole 81*a*. Thereafter, the hexagonal wrench 82 is rotated in the A3 direction (see FIG. 8). The rotating member 81 and the ball screw 816 are thereby rotated in the A3 direction. The locking of the outboard motor main body 80 by the lock clutch 314 is made ineffective at this time, and the ball screw 816 thus rotates smoothly without being constrained by the lock clutch 314. The ball nut 317 is moved in the X1 arrow direction in accordance with the rotation of the ball screw 816 in the A3 direction. Then, the transmission plate 318 is turned about the swivel shaft 310 in the X1 arrow direction in accordance with the movement of the ball nut 317 in the X1 arrow direction. The swivel shaft 310 is thereby turned in the A4 direction. Consequently, the outboard motor main body 80 is turned in the X1 arrow direction.

Other structures and operations of the second preferred embodiment are the same as those of the first preferred embodiment.

Next, an example of technical effects and merits of the outboard motor 3B according to the second preferred embodiment of the present invention shall now be described.

With the second preferred embodiment, the outboard motor main body 80 is turned in the right and left directions by the user using the hexagonal wrench 82 to rotate the rotating member 81. The user can thus turn the outboard motor main body 80 in the right and left directions more readily than in the case of turning the outboard motor main body 80 in the right and left directions by pushing.

Third Preferred Embodiment

An outboard motor 3C according to a third preferred embodiment of the present invention shall now be described with reference to FIG. 11 to FIG. 14. First, an arrangement of the outboard motor 3C shall be described in detail.

Figure 11:
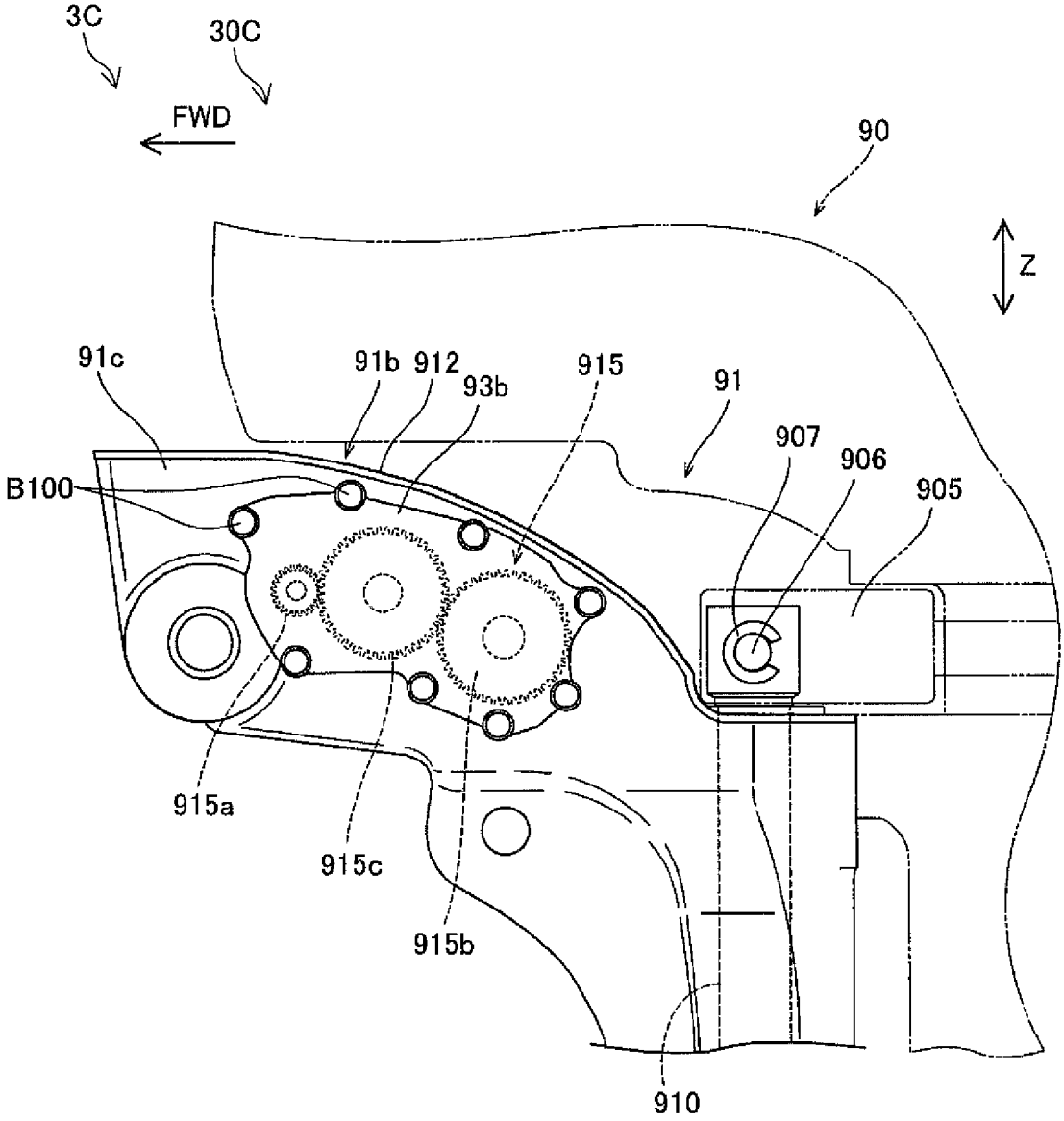
FIG. 11 is a side view for explaining an arrangement of a swivel bracket according to a third preferred embodiment of the present invention.

As shown in FIG. 11, the outboard motor 3C includes an outboard motor main body 90, and a steering apparatus 30C arranged to steer the outboard motor main body 90. The outboard motor main body 90 is an example of the "propulsion device main body" according to a preferred embodiment of the present invention. The steering apparatus 30C includes a swivel bracket 91. The swivel bracket 91 is an example of the "swivel portion" according to a preferred embodiment of the present invention.

Figure 12:
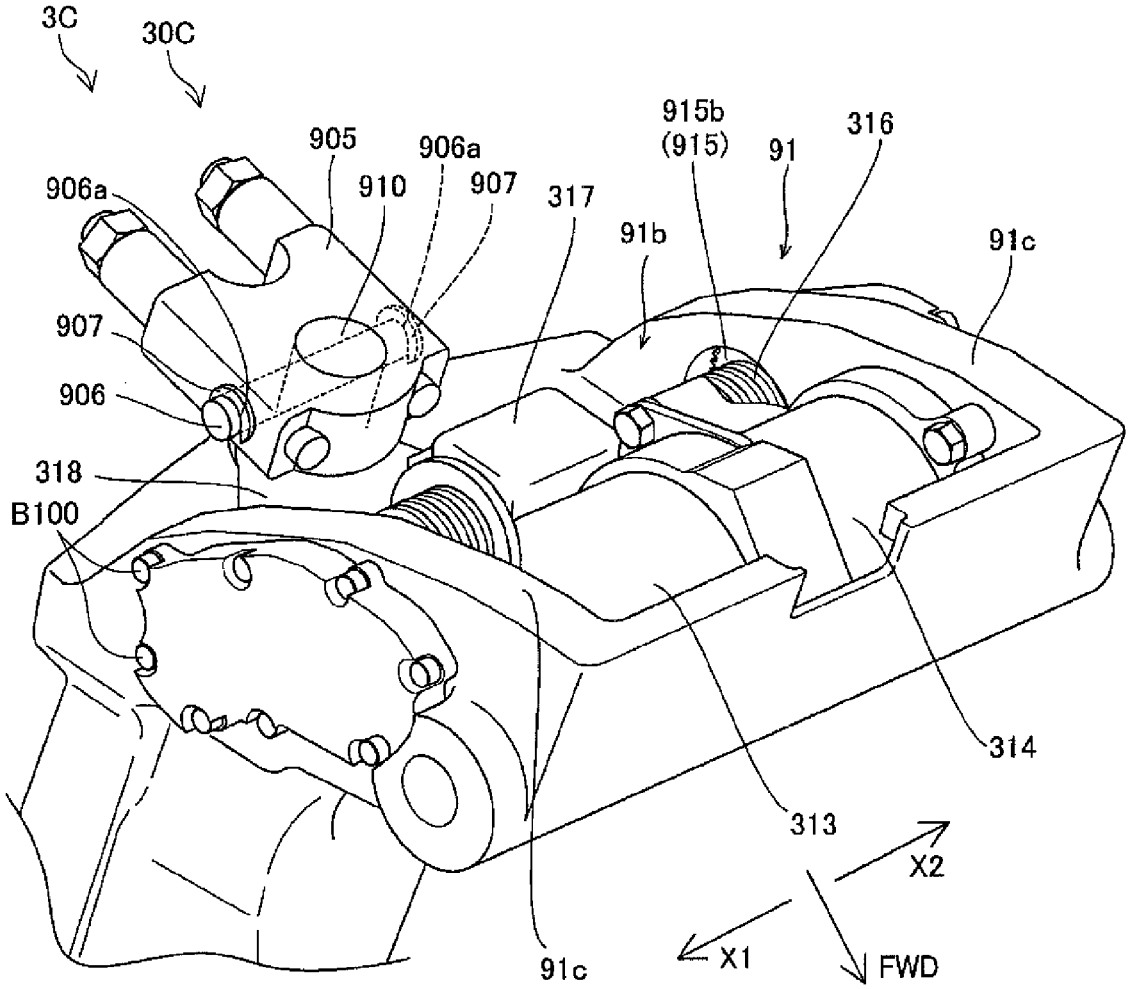
FIG. 12 is a perspective view for explaining the arrangement of the swivel bracket according to the third preferred embodiment of the present invention.

As shown in FIG. 11 and FIG. 12, a swivel shaft 910 is arranged along the up/down direction. A coupling member 905 coupling the swivel shaft 910 and the outboard motor main body 90 is arranged at an upper portion of the swivel shaft 910. The coupling member 905 is arranged to turn together with the swivel shaft 310 in accordance with the turning of the swivel shaft 910.

Figure 13:
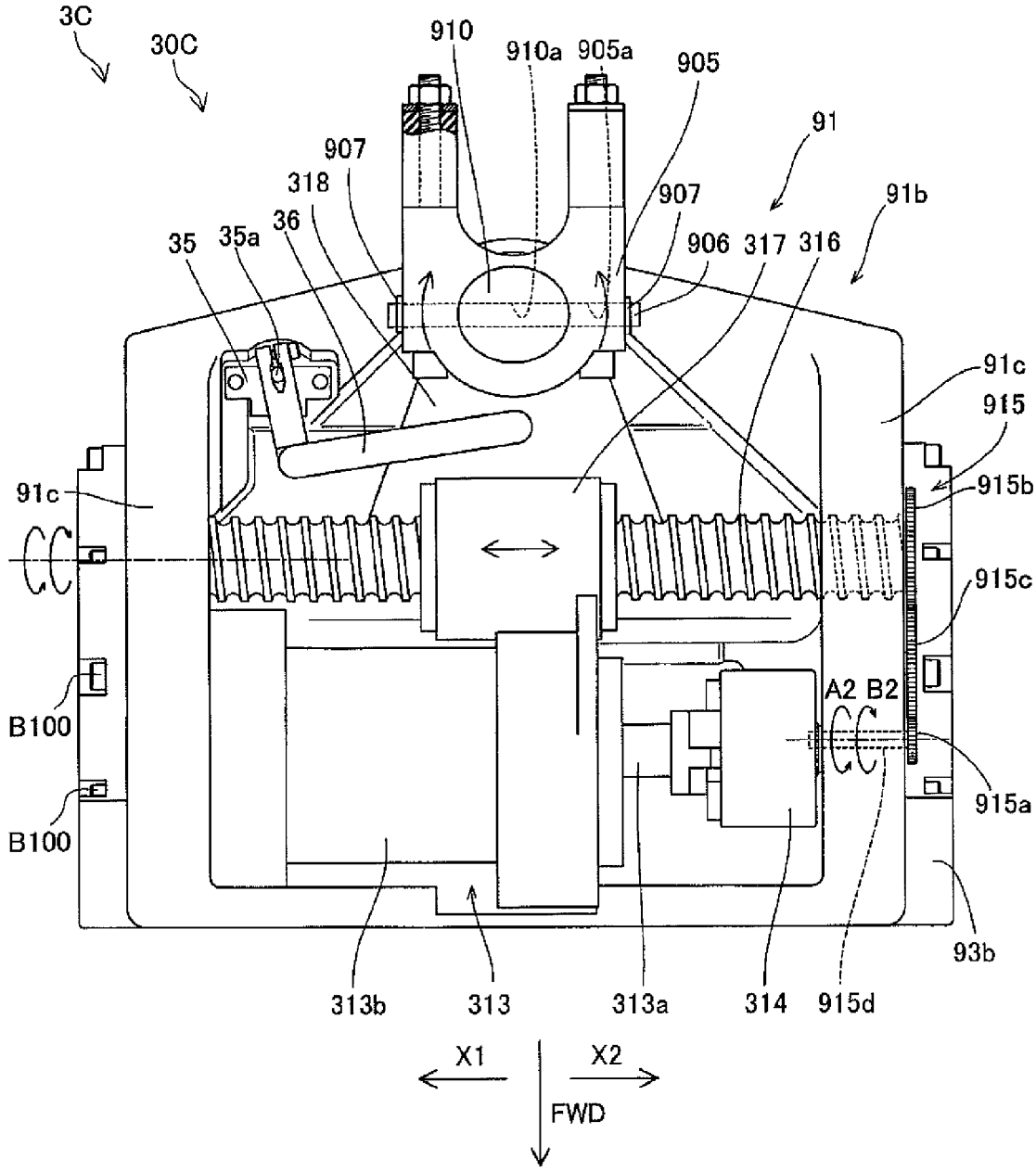
FIG. 13 is a plan view for explaining the arrangement of the swivel bracket according to the third preferred embodiment of the present invention.

As shown in FIG. 13, a through hole 910*a* and a through hole 905*a* are provided in the swivel shaft 910 and the coupling member 905, respectively. The coupling member 905 is attached to the upper portion of the swivel shaft 910 in a manner such that the through hole 905*a* is in communication with the through hole 910*a*. A pin member 906 is inserted into the through hole 910*a* and the through hole 905*a*. The pin member 906 is an example of the "lock release mechanism" according to a preferred embodiment of the present invention. As shown in FIG. 12, the pin member 906 includes two engaging grooves 906*a* provided at outer peripheral portions at respective end portions of the pin member 906. Two snap rings (C rings) 907 are attached respectively to the two engaging grooves 906*a*. Falling off of the pin member 906 from the through hole 910*a* and the through hole 905*a* is prevented by the two snap rings 907.

Also, the swivel bracket 91 includes a turning mechanism housing portion 91*b*. As shown in FIG. 12, an upper portion of the turning mechanism housing portion 91*b* is open. As shown in FIG. 11, a cover member 912 is attached to the upper portion of the turning mechanism housing portion 91*b*. The cover member 912 covers the entire opening of the turning mechanism housing portion 91*b*. An inside of the turning mechanism housing portion 91*b* is thereby sealed. Also, as shown in FIG. 11, the upper portion of the swivel shaft 910 protrudes upward from the cover member 912 at a rear portion of the cover member 912.

Also, a gear mechanism 915 is provided at a downstream side relative to the lock clutch 314. As shown in FIG. 11, the gear mechanism 915 includes an input gear 915*a*, an output gear 915*b*, and an intermediate gear 915*c* engaged with the input gear 915*a* and the output gear 915*b*. The gear mechanism 915 is housed in an inside of a plate member 93*b* that is attached to a side wall portion 91*c* of the swivel bracket 91. The gear mechanism 915 is covered by the plate member 93*b*. The plate member 93*b* is detachably attached to the side wall portion 91*c* of the swivel bracket 91, for example, by a plurality of bolts B100.

The input gear 915*a*, the output gear 915*b*, and the intermediate gear 915*c* are, for example, spur gears, respectively. As shown in FIG. 13, the input gear 915*a* is coupled to a shaft member 915*d* that protrudes from the lock clutch 314. The input gear 915*a* is arranged to rotate together with the shaft member 915*d*. Also, the output gear 915*b* is coupled to the ball screw 316. The output gear 915*b* is arranged to rotate together with the ball screw 316. The driving force of the motor 313 is applied to the input gear 915*a* via the shaft member 915*d*. Also, the driving force of the motor 313 that is applied to the input gear 915*a* is transmitted to the output gear 915*b* via the intermediate gear 915*c*. The driving force transmitted to the output gear 915*b* is output to the ball screw 316.

Figure 14:
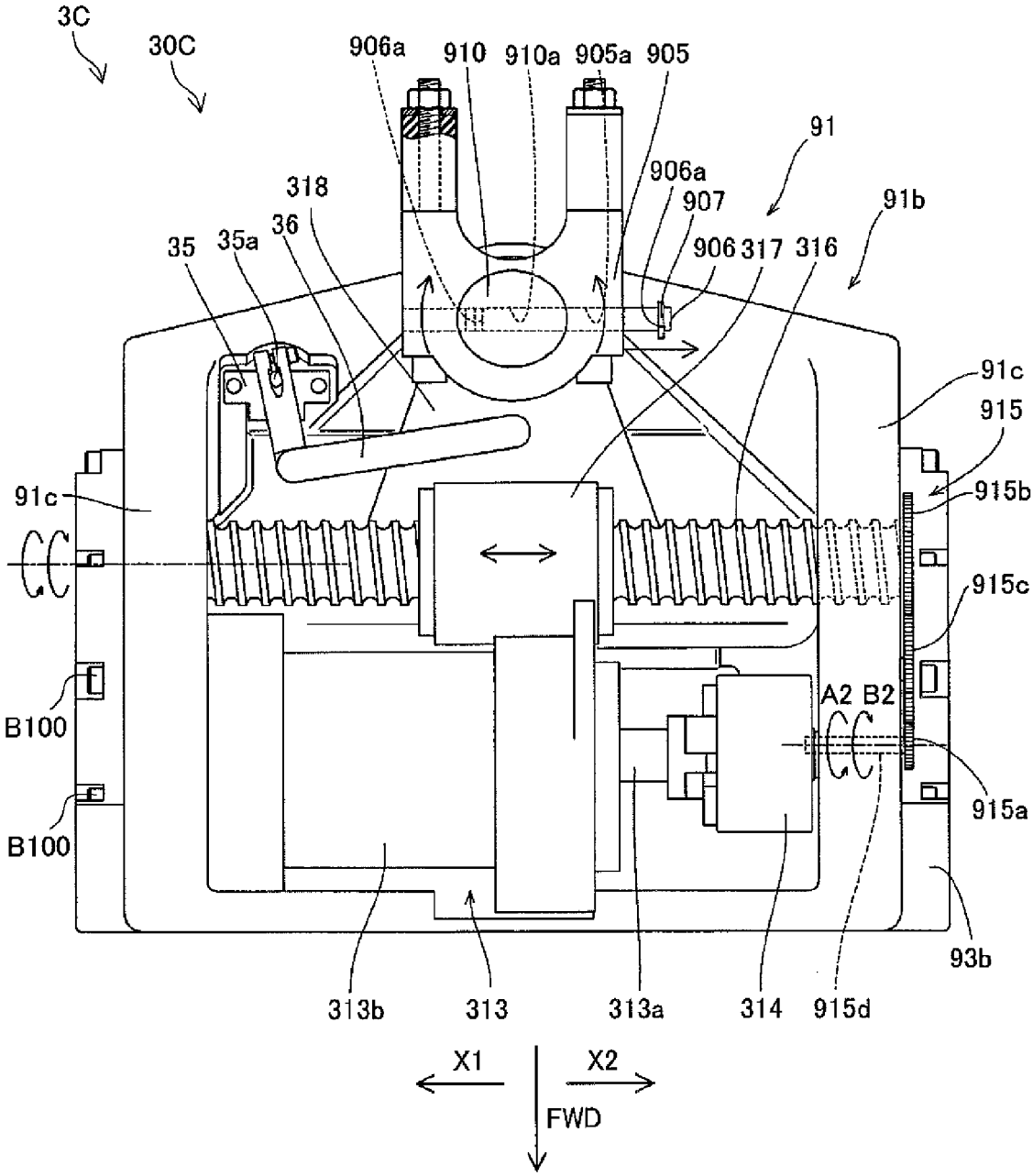
FIG. 14 is a plan view for explaining a procedure for removing a pin member according to the third preferred embodiment of the present invention.

FIG. 14 is a plan view for explaining a procedure for removing the pin member according to the third preferred embodiment of the present invention. Next, a procedure for releasing the locking of the outboard motor main body 90 by the lock clutch 314 shall now be described with reference to FIG. 11 and FIG. 14.

First, one or both of the two snap rings 907 is removed from the pin member 906, for example, by using a tool. Next, the end portion of the pin member 906 from which the snap ring 907 was removed is pressed by a tool. The pin member 906 is thereby moved with respect to the coupling member 905 and the swivel shaft 910 as shown in FIG. 14. Then, the pin member 906 is removed from the coupling member 905 and the swivel shaft 910. The coupling of the coupling member 905 and the swivel shaft 910 is thereby released. That is, the coupling of the coupling member 905 and the lock clutch 314 is released. The constraining of the coupling member 905 by the lock clutch 314 is thus released. The user can thus turn the coupling member 905 freely with respect to the upper portion of the swivel shaft 910. The user can thereby push and turn the outboard motor main body 90 in the right and left directions.

Other structures and operations of the third preferred embodiment are the same as those of the first preferred embodiment.

Next, an example of technical effects and merits of the outboard motor 3C according to the third preferred embodiment of the present invention shall now be described.

With the third preferred embodiment, the locking of the outboard motor main body 90 by the lock clutch 314 is released by the pin member 906 being removed from the coupling member 905 and the swivel shaft 910. The user can thus remove the pin member 906 to readily release the locking of the outboard motor main body 90 by the lock clutch 314.

Fourth Preferred Embodiment

An outboard motor 3D according to a fourth preferred embodiment of the present invention shall now be described with reference to FIG. 15 to FIG. 18. First, an arrangement of the outboard motor 3D shall be described in detail.

Figure 15:
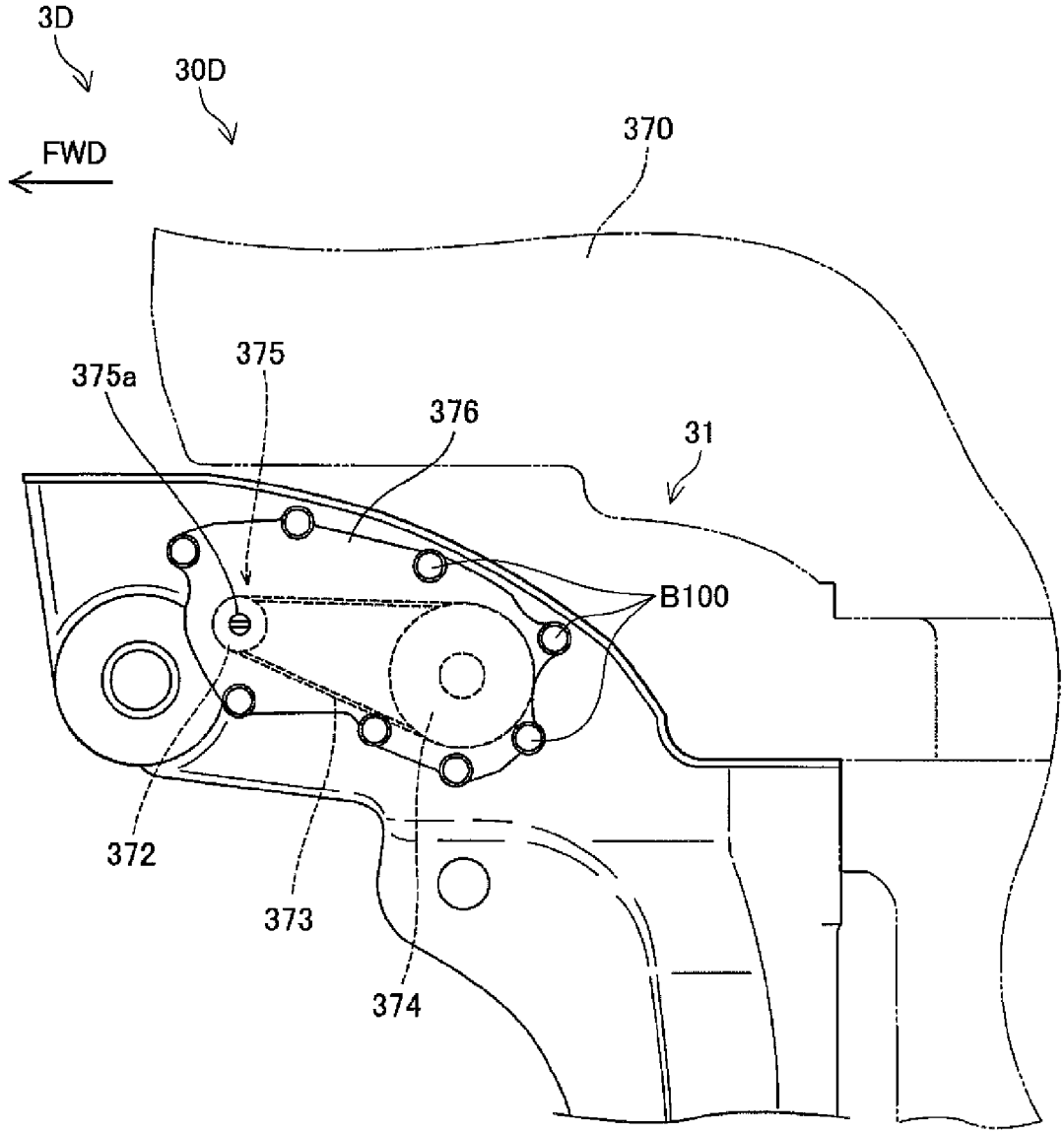
FIG. 15 is a side view for explaining an arrangement of a swivel bracket according to a fourth preferred embodiment of the present invention.
Figure 16:
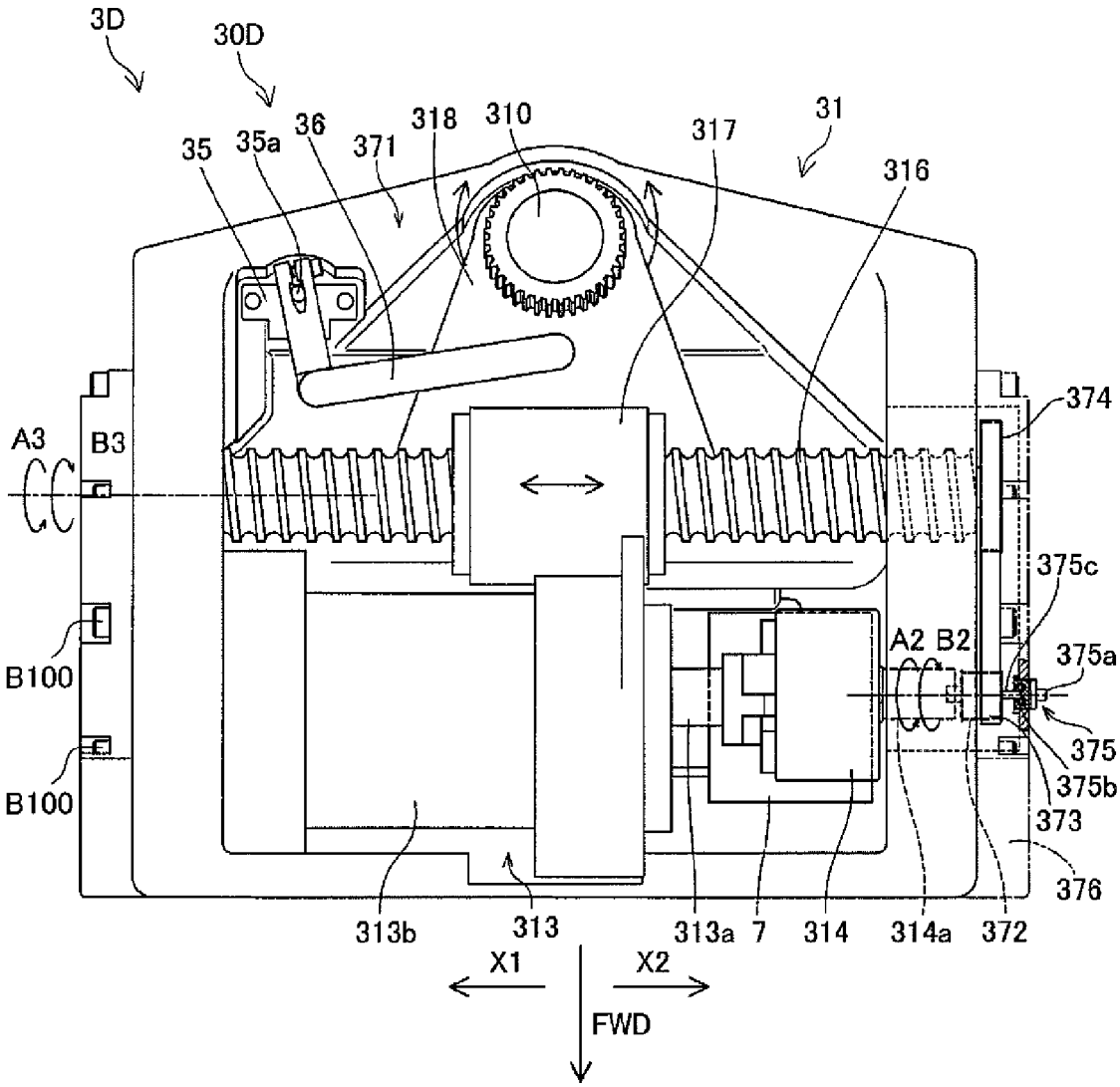
FIG. 16 is a plan view for explaining the arrangement of the swivel bracket according to the fourth preferred embodiment of the present invention.

As shown in FIG. 15, the outboard motor 3D includes an outboard motor main body 370, and a steering apparatus 30D arranged to steer the outboard motor main body 370. The outboard motor main body 370 is an example of the "propulsion device main body" according to a preferred embodiment of the present invention. As shown in FIG. 16, the steering apparatus 30D includes the swivel bracket 31, and a turning mechanism 371 including a transmitting mechanism.

As shown in FIG. 15, the transmitting mechanism includes two pulleys (a pulley 372 and a pulley 374) arranged across an interval in a front/rear direction, and an endless belt 373 spanned across the pulley 372 and the pulley 374. As shown in FIG. 16 the pulley 372 is detachably attached to an output shaft 314*a* provided on the lock clutch 314. The pulley 372 is arranged to rotate together with the output shaft 314*a*. Also, the pulley 374 is coupled to an end portion of the ball screw 316 at the X2 arrow direction side. The belt 373 is arranged to transmit force between the pulley 372 and the pulley 374. The rotation of the output shaft 314*a* is thus transmitted to the ball screw 316 via the pulley 372, the pulley 374, and the belt 373.

Figure 17:
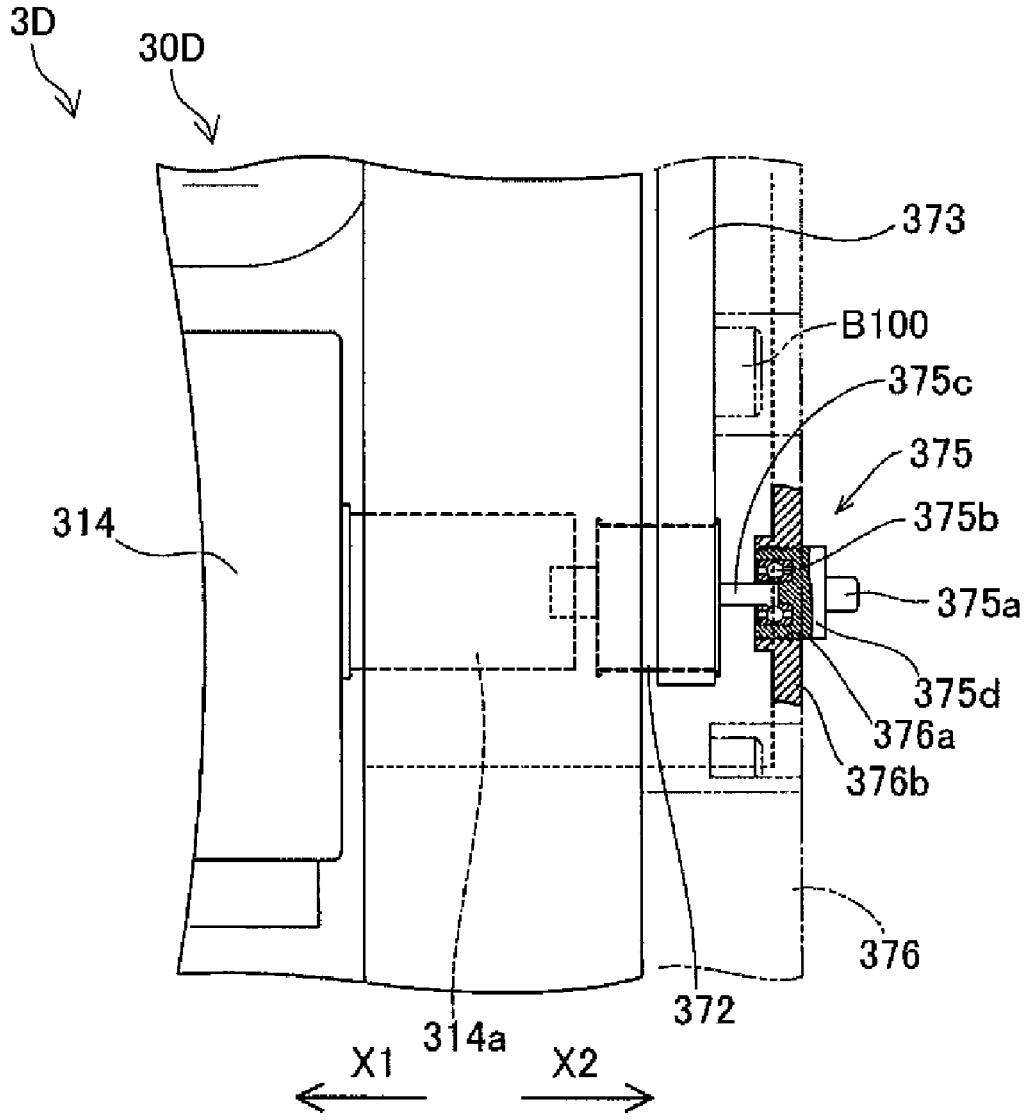
FIG. 17 is a sectional view for explaining an arrangement of a vicinity of an operating portion of the swivel bracket according to the fourth preferred embodiment of the present invention.

As shown in FIG. 17, the pulley 372 is coupled to an operating portion 375. The operating portion 375 is an example of the "lock release mechanism" according to a preferred embodiment of the present invention. By operation of the operating portion 375, the pulley 372 is moved between an attached position (position shown in FIG. 16 and FIG. 17) and a detached position (position shown in FIG. 18). The attached position is the position at which the pulley 372 is attached to the output shaft 314*a*. Also, the detached position is the position at which the pulley 372 is detached from the output shaft 314*a*. When the pulley 372 is arranged at the detached position, the transmission of force between the pulley 372 and the lock clutch 314 is stopped. The locking of the outboard motor main body 370 (see FIG. 15) by the lock clutch 314 is thus released by the pulley 372 being arranged at the detached position.

Figure 18:
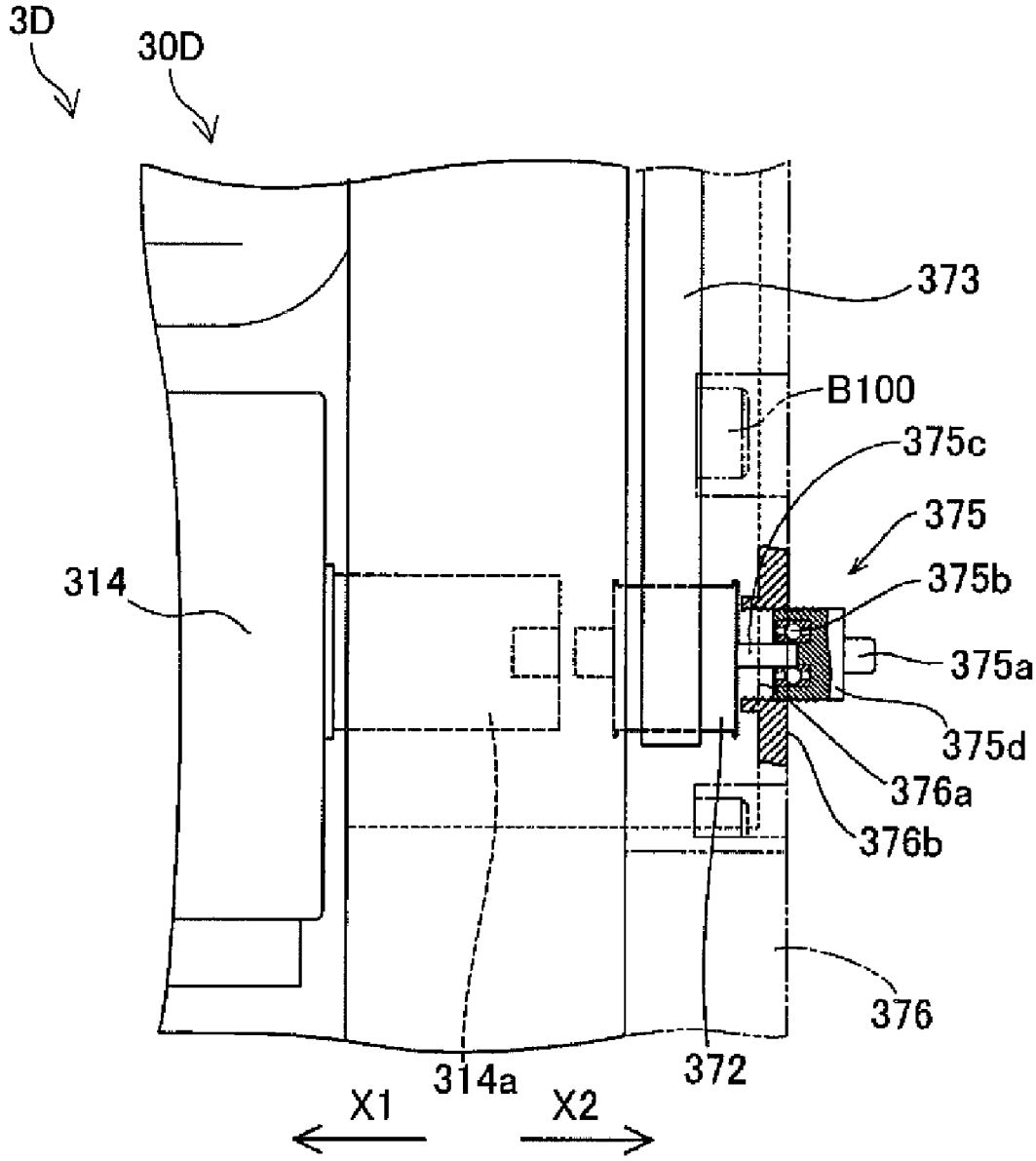
FIG. 18 is a sectional view for explaining the arrangement of the vicinity of the operating portion of the swivel bracket according to the fourth preferred embodiment of the present invention.

As shown in FIG. 18, the operating portion 375 includes a lid portion 375*a*, a bearing 375*b*, and a shaft portion 375*c*. The lid portion 375*a* includes a hollow threaded portion corresponding to a threaded hole portion 376*a* provided in a plate member 376, and a flange portion 375*d* arranged to be in planar contact with outer surface 376*b* of the plate member 376. The bearing 375*b* is fitted in an inside of the lid portion 375*b*. An outer periphery of the bearing 375*b* is coupled to the lid portion 375*a*. Also, the shaft portion 375*c* is inserted in an inner periphery of the bearing 375*b*. The shaft portion 375*c* is coupled to the lid portion 375*a* via the bearing 375*b*. The shaft portion 375*c* and the lid portion 375*a* are arranged to rotate in a relative manner.

Also, the shaft portion 375*c* is coaxially coupled to a central portion of the pulley 372. The shaft portion 375*c* is arranged to rotate together with the pulley 372. The shaft portion 375*c* is coupled to the lid portion 375*a* via the bearing 375*b*, and thus when the output shaft 314*a* is rotated in a state where the pulley 372 is arranged at the attached position, the shaft portion 375*c* and the pulley 372 rotate relative to the lid portion 375*a* in a relative manner. Transmission of rotation from the pulley 372 to the lid portion 375 is thereby prevented. Relative movement of the lid portion 375*a* with respect to the threaded hole portion 376*a* in accordance with the rotation of the pulley 372 is thus prevented.

When the operating portion 375 is rotated from a side of the plate member 376 by the user, a fitting length of the lid portion 375*a* with respect to the threaded hole portion 376*a* changes and the operating portion 375 is moved in the X1 arrow direction or the X2 arrow direction. In accordance with the movement of the operating portion 375 in the X1 arrow direction or the X2 arrow direction, the pulley 372 is moved in the X1 arrow direction or the X2 arrow direction. The pulley 372 is thereby moved between the attached position and the detached position. When the pulley 372 is arranged at the attached position, the pulley 372 is attached to the output shaft 314*a*. Also, when the pulley 372 is arranged at the attached position, the flange portion 375*d* is in planar contact with the outer surface 376*b* of the plate member 376. Entry of water into the inside of the swivel bracket 31 is thereby prevented.

Next, an example of technical effects and merits of the outboard motor 3D according to the fourth preferred embodiment of the present invention shall now be described.

With the fourth preferred embodiment, the pulley 372 is moved between the attached position and the detached position by the user rotating the operating portion 375. The user can thus operate the operating portion 375 to readily release the locking of the outboard motor main body 370 by the lock clutch 314.

Fifth Preferred Embodiment

Figure 19:
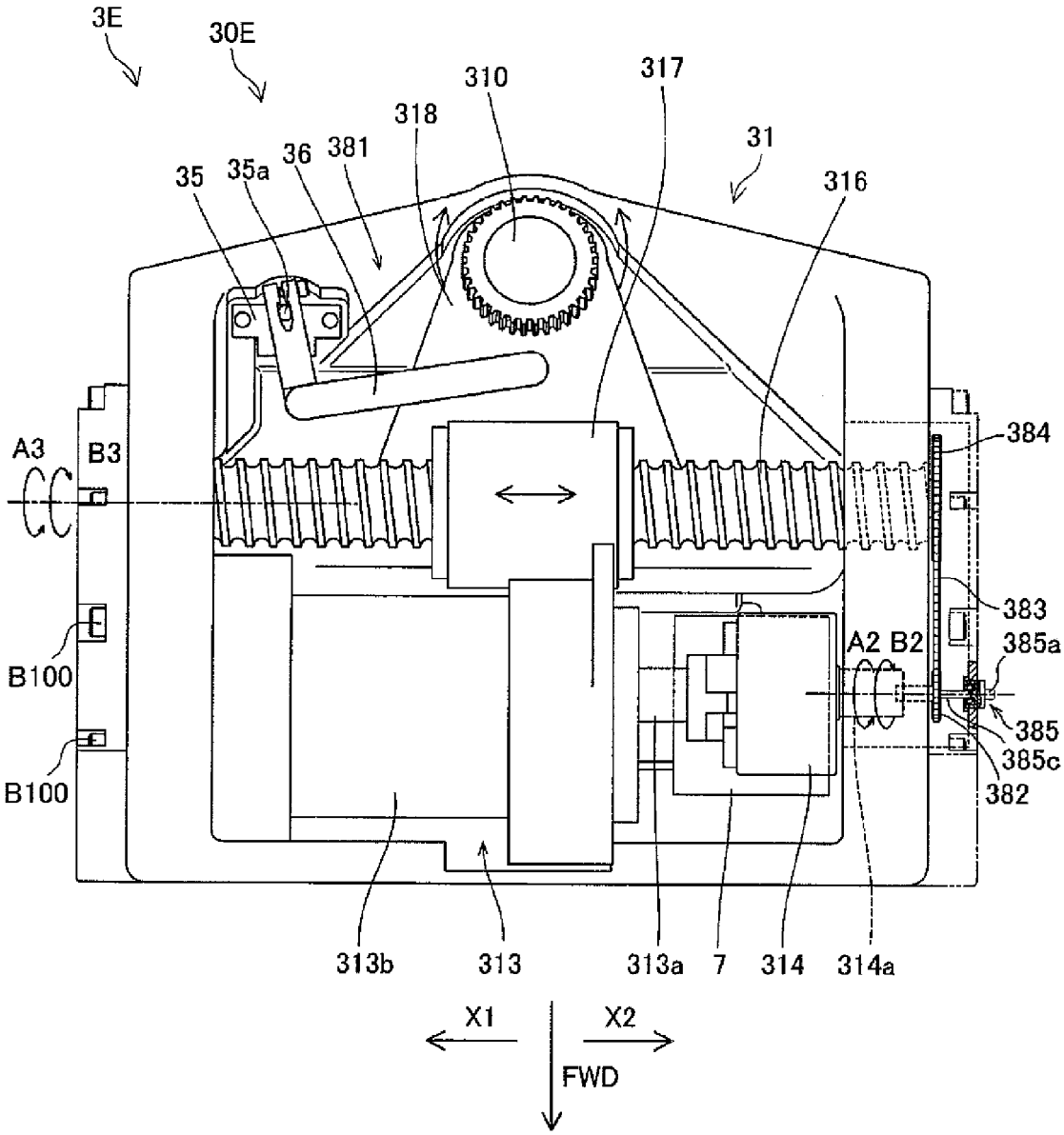
FIG. 19 is a plan view for explaining an arrangement of a swivel bracket according to a fifth preferred embodiment of the present invention.

An arrangement of an outboard motor 3E according to a fifth preferred embodiment of the present invention shall now be described in detail with reference to FIG. 19.

The outboard motor 3E includes an outboard motor main body (not shown), and a steering apparatus 30E arranged to steer the outboard motor main body. The steering apparatus 30E includes the swivel bracket 31, and a turning mechanism 381 including a transmitting mechanism. The transmitting mechanism includes two sprockets (a sprocket 382 and a sprocket 384), and an endless chain 383 spanned across the sprocket 382 and the sprocket 384. The sprocket 382 is detachably attached to the output shaft 314*a* provided on the lock clutch 314. The sprocket 382 is arranged to rotate together with the output shaft 314*a*. Also, the sprocket 384 is coupled to an end portion of the ball screw 316 at the X2 arrow direction side. The chain 383 is arranged to transmit force between the sprocket 382 and the sprocket 374. The rotation of the output shaft 314*a* is thus transmitted to the ball screw 316 via the sprocket 382, the sprocket 384, and the chain 383.

The sprocket 382 is coupled to an operating portion 385. The operating portion 385 is an example of the "lock release mechanism" according to a preferred embodiment of the present invention. By operation of the operating portion 385, the sprocket 382 is moved between an attached position (position shown in FIG. 19) and a detached position. The attached position is the position at which the sprocket 382 is attached to the output shaft 314*a*. Also, the detached position is the position at which the sprocket 382 is detached from the output shaft 314*a*. When the sprocket 382 is arranged at the detached position, the transmission of force between the sprocket 382 and the lock clutch 314 is stopped. The locking of the outboard motor main body by the lock clutch 314 is thus released by the sprocket 382 being arranged at the detached position.

Sixth Preferred Embodiment

An arrangement of an outboard motor 3F according to a sixth preferred embodiment of the present invention shall now be described in detail with reference to FIG. 20 to FIG. 24.

Figure 20:
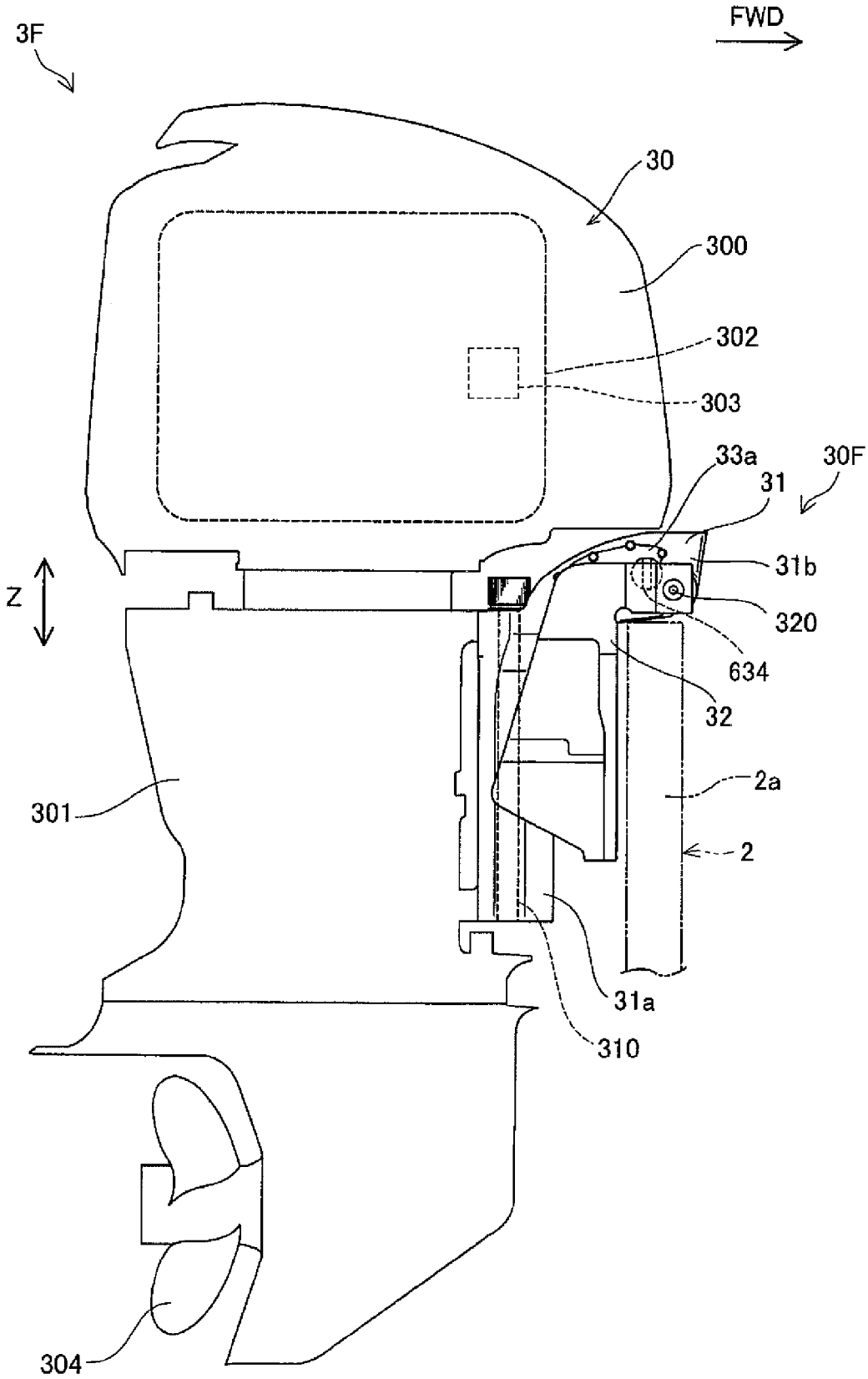
FIG. 20 is a side view of an overall arrangement of an outboard motor according to a sixth preferred embodiment of the present invention.

As shown in FIG. 20, the outboard motor 3F includes the outboard motor main body 30, and a steering apparatus 30F arranged to steer the outboard motor main body 30. The steering apparatus 30F includes the swivel bracket 31, and the tilt bracket 32. The outboard motor main body 30 is an example of the "propulsion device main body" according to a preferred embodiment of the present invention. Also, the swivel bracket 31 is an example of the "swivel portion" according to a preferred embodiment of the present invention. The outboard motor main body 30 is attached to the swivel bracket 31. Also, the swivel bracket 31 is attached to the tilt bracket 32. The tilt bracket 32 is fixed to the stern plate 2*a* provided at the rear portion of the hull 2. The outboard motor main body 30 is thus attached to the hull 2 via the swivel bracket 31 and the tilt bracket 32.

The outboard motor main body 30 is coupled to the swivel bracket 31 in a manner enabling turning in the right and left directions about the swivel shaft 310 that extends in the vertical direction. The swivel bracket 31 is coupled to the tilt bracket 32 in a manner enabling the outboard motor main body 30 to turn in the up and down directions (Z direction) about the tilt shaft 320 that extends in the width direction (X1 arrow direction and X2 arrow direction of FIG. 1) of the hull 2. Thus, the outboard motor main body 30 is thus held with respect to the hull 2 in a manner enabling turning in the right and left directions about the swivel shaft 310. The outboard motor main body 30 is also held with respect to the hull 2 in a manner enabling turning in the up and down directions about the tilt shaft 320.

Also, as shown in FIG. 20, the outboard motor main body 30 includes the engine cover 300 provided at an upper portion of the outboard motor main body 30, and the case 301 provided below the engine cover 300. The engine 302 and the ECU 303 are housed inside the engine cover 300. Also, the propeller 304 is provided at the lower portion of the case 301. The propeller 304 is driven to rotate by the engine 302.

Next, a structure of the swivel bracket 31 according to the sixth preferred embodiment shall now be described in detail.

Figure 21:
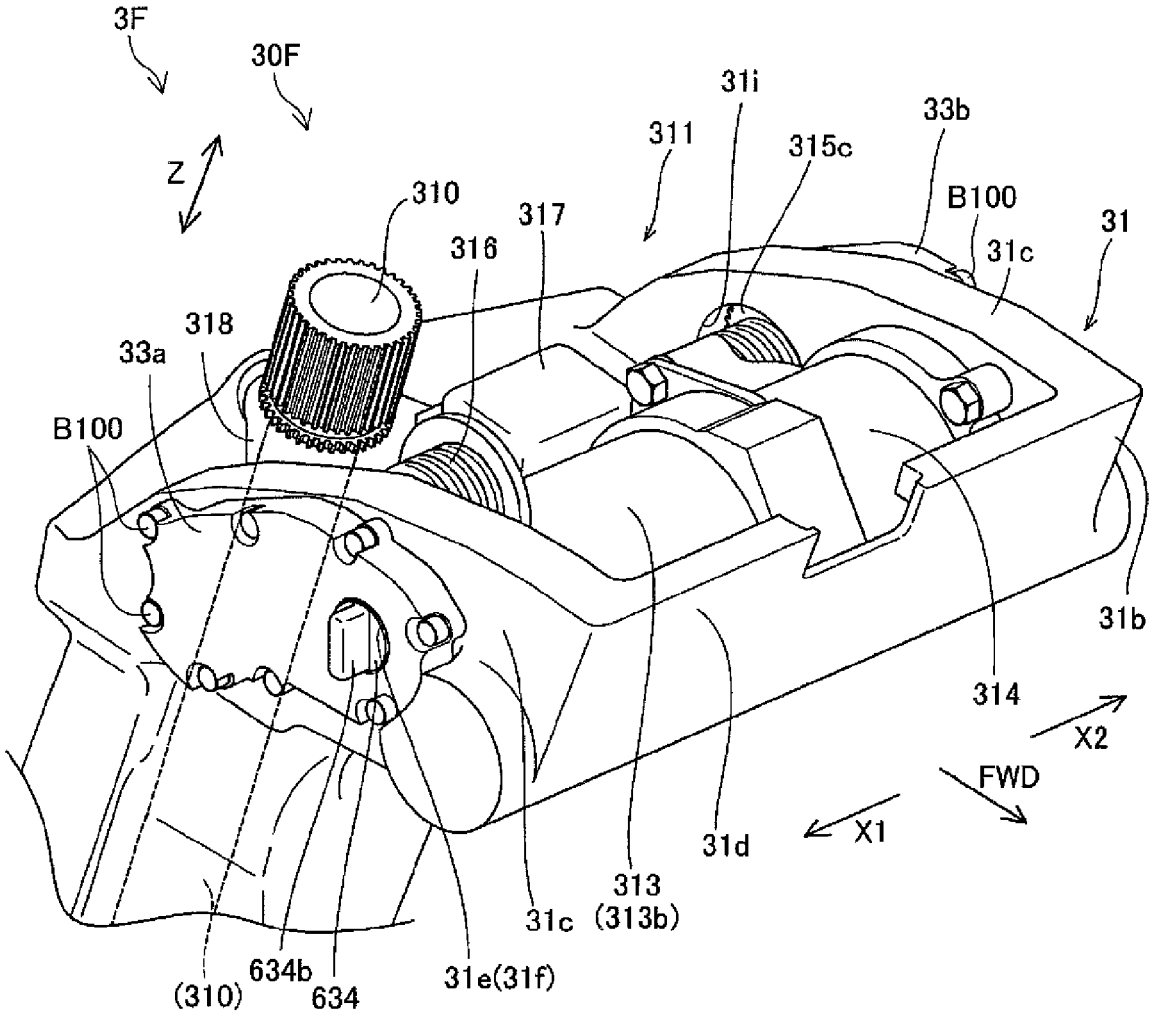
FIG. 21 is a perspective view for explaining an arrangement of a swivel bracket according to the sixth preferred embodiment of the present invention.

As shown in FIG. 20, the swivel bracket 31 includes the swivel shaft holding portion 31*a*, and the turning mechanism housing portion 31*b*. The swivel shaft holding portion 31*a* is arranged to extend in the up/down direction. The swivel shaft 310 is held by the swivel shaft holding portion 31*a* in a state of being arranged along the up/down direction. The upper portion of the swivel shaft 310 is arranged inside of the turning mechanism housing portion 31*b*. As shown in FIG. 21, the turning mechanism 311 that is arranged to turn the swivel shaft 310 is arranged inside of the turning mechanism housing portion 31*b*.

Figure 22:
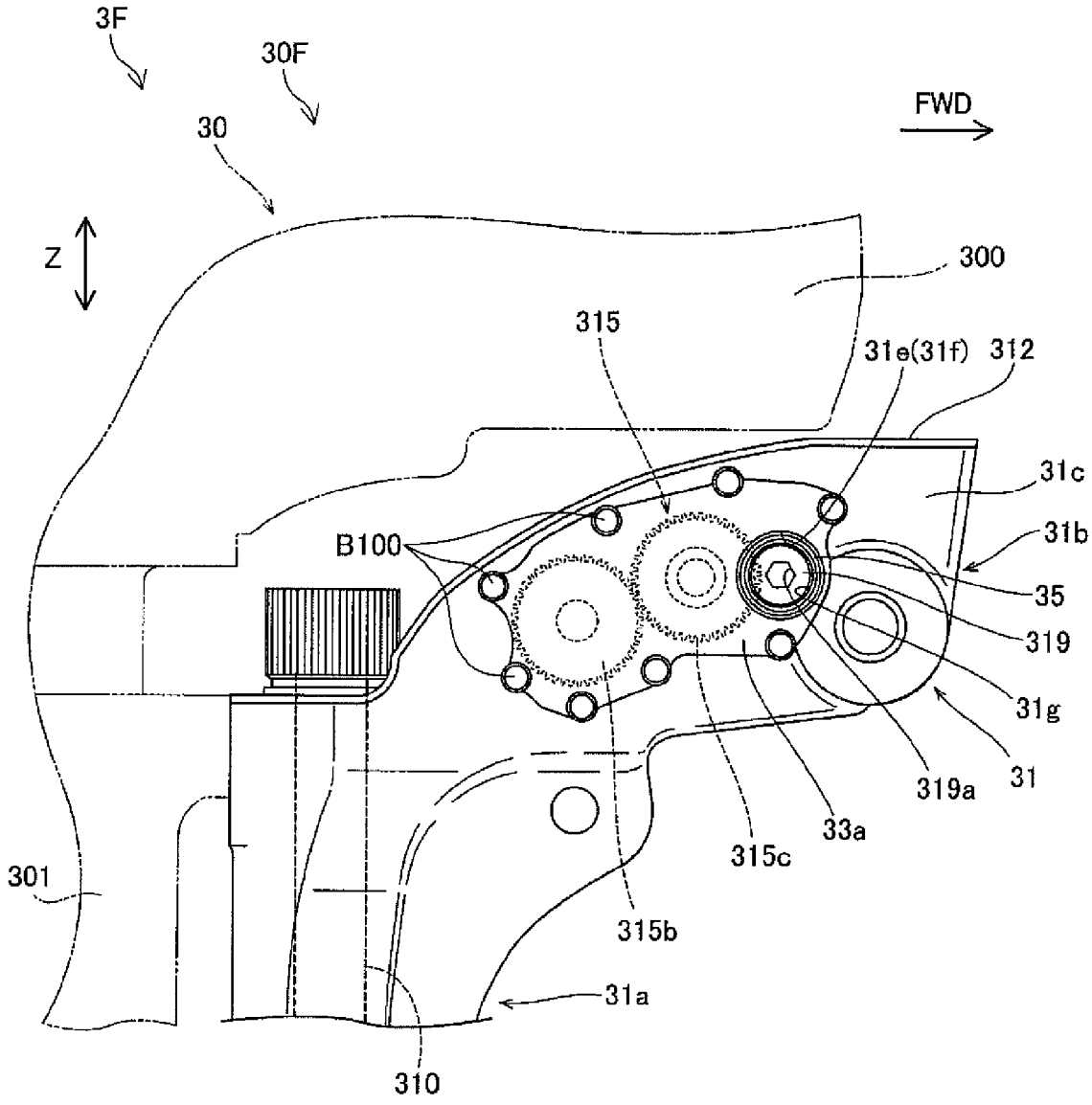
FIG. 22 is a side view for explaining the arrangement of the swivel bracket according to the sixth preferred embodiment of the present invention.

As shown in FIG. 22, the turning mechanism housing portion 31*b* is coupled to the upper portion of the swivel shaft holding portion 31*a*. The turning mechanism housing portion 31*b* is arranged to protrude forward (in the FWD arrow direction) from the upper portion of the swivel shaft holding portion 31*a*. As shown in FIG. 21, the turning mechanism housing portion 31*b* includes the pair of side wall portions 31*c* arranged to extend forward from the upper portion of the swivel shaft holding portion 31*a*, and the front wall portion 31*d* connecting the front portions of the pair of side wall portions 31*c*. The turning mechanism housing portion 31*b* has the shape of a box that is opened at the upper portion. As shown in FIG. 22, the cover member 312 is attached to the upper portion of the turning mechanism housing portion 31*b*. The cover member 312 covers the entirety of the opening of the turning mechanism housing portion 31*b*. The inside of the turning mechanism housing portion 31*b* is thereby sealed.

Also, as shown in FIG. 21, the pair of side wall portions 31*c* are arranged in parallel or substantially in parallel across an interval in the width direction of the hull 2. The plate member 33*a* is detachably attached, for example, by the plurality of bolts B100 to the side wall portion 31*c* arranged at the X1 arrow direction side. Also, the plate member 33*b* is detachably attached, for example, by the plurality of bolts B100 to the side wall portion 31*c* arranged at the X2 arrow direction side. The plate member 33*a* covers the outer surface of the side wall portion 31*c* at the X1 arrow direction side. Also, the plate member 33*b* covers the outer surface of the side wall portion 31*c* at the X2 arrow direction side.

Figure 23:
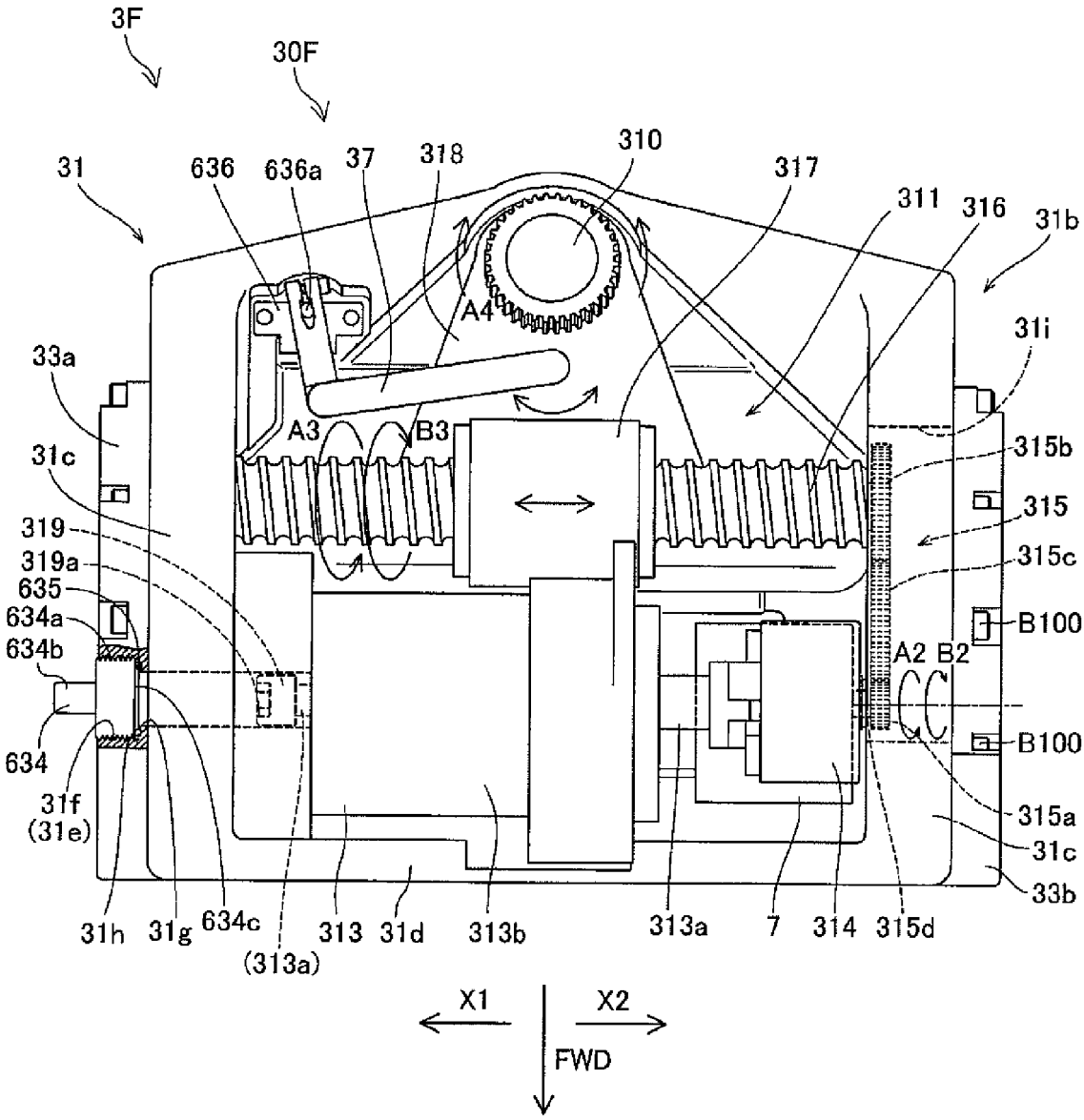
FIG. 23 is a plan view for explaining the arrangement of the swivel bracket according to the sixth preferred embodiment of the present invention.

Also, as shown in FIG. 23, the turning mechanism 311 includes the motor 313 including the motor shaft 313*a*, the lock clutch 314, and the gear mechanism 315. The motor 313 generates the driving force to turn the outboard motor main body 30 (see FIG. 20) in the right and left directions. The motor shaft 313*a* of the motor 313 is driven to rotate by electricity. The lock clutch 314 is coupled to the motor shaft 313*a*. The gear mechanism 315 is coupled to the lock clutch 314. The lock clutch 314 is an example of the "lock portion" according to a preferred embodiment of the present invention.

Also, as shown in FIG. 23, the turning mechanism 311 further includes the ball screw 316, the ball nut 317 attached to the ball screw 316, and the transmission plate 318 coupled to the ball nut 317. The ball screw 316 is arranged along the width direction of the hull 2. The rotation of the motor shaft 313*a* is transmitted to the ball screw 316 via the lock clutch 314 and the gear mechanism 315. Also, the rotation of the ball screw 316 is converted to movement of the ball nut 317 in the width direction of the hull 2. The transmission plate 318 is arranged to be turned about the swivel shaft 310 in accordance with the movement of the ball nut 317.

As shown in FIG. 23, the motor 313 is housed in the turning mechanism housing portion 31*b*. The motor 313 is arranged along the inner surface of the front wall portion 31*d*. The lock clutch 314 is arranged between the motor 313 and the side wall portion 31*c* at the X2 arrow direction side. The motor 313 includes the motor shaft 313*a*, and the motor main body 313*b*. The motor shaft 313*a* is arranged along the width direction of the hull 2. The motor shaft 313*a* is arranged to protrude in the width direction of the hull 2 from the motor main body 313*b*. The motor shaft 313*a* includes the first end portion protruding to the lock clutch 314 side from the motor main body 313*b*, and a second end portion protruding to an opposite side with respect to the lock clutch 314 from the motor main body 313*b*.

The motor 313 is electrically connected to the driver 7. The driver 7 is arranged to control the motor 313 based on the signal transmitted from the steering portion 4 (see FIG. 1) via the LAN cable 6 (see FIG. 1). Specifically, when the steering portion 4 is rotated in the A1 direction (see FIG. 1), the driver 7 controls the motor 313 to rotate the motor shaft 313*a* in the A2 direction (see FIG. 23). Also, when the steering portion 4 is rotated in the B1 direction (see FIG. 1), the driver 7 controls the motor 313 to rotate the motor shaft 313*a* in the B2 direction (see FIG. 23).

As shown in FIG. 23, a rotating member 319 is attached to the end portion (second end portion) of the motor shaft 313*a* at the opposite side with respect to the lock clutch 314. The rotating member 319 is an example of the "manual steering portion" according to a preferred embodiment of the present invention. The rotating member 319 is coaxially coupled to the motor shaft 313*a*. The rotating member 319 includes a hexagonal hole 319*a* provided at an end portion of the rotating member 319 at the X1 arrow direction side. The user attaches the hexagonal wrench 82 (see FIG. 24) to the hexagonal hole 319*a*. The rotating member 319 is rotated by the hexagonal wrench 82, attached to the hexagonal hole 319*a*, being rotated by the user. Also, the motor shaft 313*a* is rotated by the rotating member 319 being rotated. The user can thus rotate the motor shaft 313*a* by rotating the rotating member 319 using the hexagonal wrench 82.

As shown in FIG. 23, an opening portion 31*e* that penetrates through the side wall portion 31*c* at the X1 arrow direction side and the plate member 33*a* in the width direction of the hull 2 is provided in the swivel bracket 31 and the plate member 33*a*. The rotating member 319 is arranged inside the opening portion 31*e*. Also, the opening portion 31*e* is closed by a lid member 634. The lid member 634 is arranged to be detachable with respect to the plate member 33*a*.

As shown in FIG. 23, the opening portion 31*e* includes a threaded portion 31*f* in which a thread is provided, a hole portion 31*g* having a smaller diameter than the threaded portion 31*f*, and a step portion 31*h* provided between the threaded portion 31*f* and the hole portion 31*g*. The lid member 634 includes a threaded portion 634*a* corresponding to the threaded portion 31*f* of the opening portion 31*e*, and a knob portion 634*b* arranged to be held by the user. The lid member 634 is detached from the opening portion 31*e* by the knob portion 634*b* being held and rotated by the user. The hexagonal wrench 82 is inserted from an outside of the swivel bracket 31 and the plate member 33*a* into the opening portion 31*e* in a state where the lid member 634 is detached. The hexagonal wrench 82 is thereby attached to the hexagonal hole 319*a*.

Also, as shown in FIG. 23, an O-ring 635 that seals the interval between the lid member 634 and the opening portion 31*e* is provided at the step portion 31*h* of the opening portion 31*e*. The O-ring 635 is arranged so as to be sandwiched by a bottom portion 634*c* of the lid member 634 and the step portion 31*h* when the lid member 634 is attached to the threaded portion 31*f*. The swivel bracket 31 has a high sealing property.

The lock clutch 314 is arranged in the driving force transmission path leading from the motor 313 to the outboard motor main body 30. The lock clutch 314 is arranged to transmit a force from the upstream side of the transmission path to the downstream side of the transmission path and be locked when a force is applied from the downstream side to thereby prevent transmission of the force to the upstream side. The lock clutch 314 is, for example, a reverse input shutoff clutch (for example, Torque Diode®, made by NTN Corporation). The lock clutch 314 has a mechanical structure including a ratchet mechanism (not shown), etc., arranged inside of the lock clutch 314. The rotation of the motor 313 is transmitted to the lock clutch 314. That is, the driving force of the motor 313 is input from the upstream side into the lock clutch 314. The rotation applied to the lock clutch 314 from the motor 313 is thus transmitted to the gear mechanism 315.

Meanwhile, for example, during running of the hull 2, the outboard motor main body 30 is pushed by water and a force (reaction force) to turn the outboard motor main body 30 in the right and left directions is applied to the outboard motor main body 30. This force is applied to the lock clutch 314 via the gear mechanism 315. That is, the force applied to the outboard motor main body 30 is applied to the lock clutch 314 from the downstream side. Thus, in this case, the lock clutch 314 locks and the rotation of the gear mechanism 315 is prevented. The turning of the outboard motor main body 30 in the right and left directions is thereby locked. Thus, even if the motor 313 is not driven during the running of the hull 2, the turning of the outboard motor main body 30 in the right and left directions is locked by the lock clutch 314. The motor 313 thus does not have to be driven constantly during the running of the hull 2.

Also, when the user rotates the rotating member 319 manually, the motor shaft 313*a* is rotated. That is, the steering force to turn the outboard motor main body 30 in the right and left directions is applied to the transmission path. This steering force is applied at the upstream side relative to the lock clutch 314 and thus the lock clutch 314 is not locked by the application of the steering force. The steering force applied to the motor shaft 313*a* is thus transmitted to the outboard motor main body 30 through the transmission path. The outboard motor main body 30 is thereby turned manually in the right and left directions. The user can thus turn the outboard motor main body 30 in the right and left directions without using the driving force of the motor 313.

Also, as shown in FIG. 23, the gear mechanism 315 includes the input gear 315*a*, the output gear 315*b*, and the intermediate gear 315*c* engaged with the input gear 315*a* and the output gear 315*b*. The input gear 315*a*, the output gear 315*b*, and the intermediate gear 315*c* are, for example, spur gears, respectively. As shown in FIG. 23, the gear mechanism 315 is arranged inside an opening portion 31*i* provided in the side wall portion 31*c* at the X2 arrow direction side. The opening 31*i* is closed by the plate member 33*b*.

As shown in FIG. 23, the input gear 315*a* is coupled to the shaft member 315*d* that protrudes from the lock clutch 314. The input gear 315*a* is arranged to rotate together with the shaft member 315*d*. Also, the output gear 315*b* is coupled to the ball screw 316. The output gear 315*b* is arranged to rotate together with the ball screw 316. The driving force of the motor 313 is applied to the input gear 315*a* via the shaft member 315*d*. Also, the driving force applied to the input gear 315*a* is transmitted to the output gear 315*b* via the intermediate gear 315*c*. The driving force transmitted to the output gear 315*b* is output to the ball screw 316.

The rotation of the motor shaft 313*a* is transmitted to the ball screw 316 via the gear mechanism 315. The ball nut 317 is arranged to move in the X1 arrow direction or the X2 arrow direction in accordance with the rotation of the ball screw 316. Specifically, when the motor shaft 313*a* is rotated in the A2 direction (see FIG. 23), the ball screw 316 is rotated in the A3 direction (see FIG. 23). The ball nut 317 is arranged to move in the X1 arrow direction in accordance with the rotation of the ball screw 316 in the A3 direction. Also, when the motor shaft 313*a* is rotated in the B2 direction (see FIG. 23), the ball screw 316 is rotated in the B3 direction (see FIG. 23). The ball nut 317 is arranged to move in the X2 arrow direction in accordance with the rotation of the ball screw 316 in the B3 direction.

The ball nut 317 is coupled to the transmission plate 318. Also, the transmission plate 318 is coupled to the swivel shaft 310. The transmission plate 318 is arranged to be turned in the right and left directions about the swivel shaft 310 in accordance with the movement of the ball nut 317 in the X1 axis direction or the X2 axis direction. Also, the swivel shaft 310 is arranged to be turned in accordance with the turning of the transmission plate 318. The turning amount of the transmission plate 318 is computed based on a detection value of a turning sensor 636 (see FIG. 23) arranged at the X1 arrow direction side of the transmission plate 318.

As shown in FIG. 23, the turning sensor 636 includes a turning shaft 636*a* arranged at the X1 arrow direction side of the transmission plate 318. The turning sensor 636 is coupled by a link member 37 to the transmission plate 318. The link member 37 is arranged to move in accordance with the turning of the transmission plate 318 about the swivel shaft 310. The turning shaft 636*a* is arranged to be turned in accordance with the movement of the link member 37. The turning amount of the transmission plate 318 is computed based on a turning amount of the turning shaft 636*a* by the computing mechanism that includes the ECU 303 (see FIG. 1).

Next, an operation during manual turning of the outboard motor main body 30 in the right and left directions by the user shall now be described.

Figure 24:
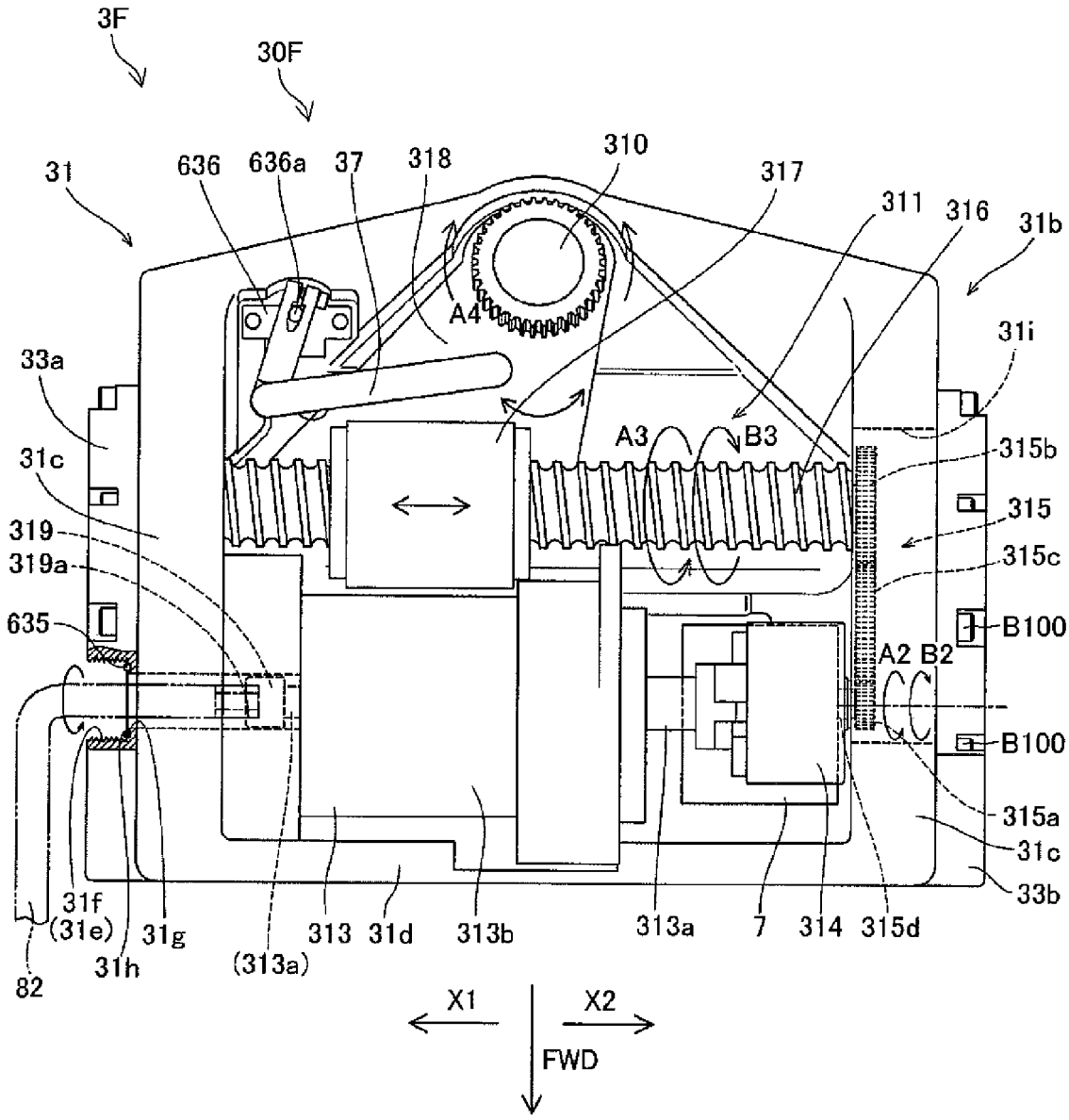
FIG. 24 is a plan view for explaining the arrangement of the swivel bracket according to the sixth preferred embodiment of the present invention.

As shown in FIG. 24, the hexagonal wrench 82 is inserted into the opening portion 31*e* in the state where the lid member 634 is detached from the opening portion 31*e*. The end portion of the hexagonal wrench 82 is then fitted into the hexagonal hole 319*a*. Thereafter, the hexagonal wrench 82 is rotated in the A2 direction. The rotating member 319 and the motor shaft 313*a* are thereby rotated in the A2 direction. That is, the steering force to turn the outboard motor main body 30 in the right and left directions is applied to the motor shaft 313*a*. The steering force is transmitted to the input gear 315*a* via the lock clutch 314. The input gear 315*a* is thereby rotated in the A2 direction, and the rotation of the input gear 315*a* in the A2 direction is transmitted to the output gear 315*b* via the intermediate gear 315*c*. The output gear 315*b* and the ball screw 316 are thereby rotated in the A3 direction. The ball nut 317 is moved in the X1 arrow direction in accordance with the rotation of the ball screw 316 in the A3 direction. The transmission plate 318 is turned about the swivel shaft 310 in the X1 arrow direction in accordance with the movement of the ball nut 317 in the X1 arrow direction. The swivel shaft 310 is thereby turned in the A4 direction. Consequently, the outboard motor main body 30 is turned in the X1 arrow direction (see FIG. 20). The outboard motor main body 30 is moved from a straight travel position (center of turning) to a turning position by the rotating member 319 being rotated, for example, by approximately 30 to 40 times.

Next, examples of technical effects and merits of the outboard motor 3F according to the sixth preferred embodiment of the present invention shall now be described.

With the sixth preferred embodiment, when a force (for example, a reaction force from water) that turns the outboard motor main body 30 in the right and left directions is applied to the outboard motor main body 30, the force is transmitted to the lock clutch 314. That is, the force applied to the outboard motor main body 30 is applied to the lock clutch 314 from the downstream side. The lock clutch 314 is thereby locked and locks the turning of the outboard motor main body 30 in the right and left directions. Thus, even if the motor 313 is not driven during running of the hull 2, the turning of the outboard motor main body 30 in the right and left directions is locked by the lock clutch 314. The motor 313 thus does not have to be driven constantly during the running of the hull 2. The load of the motor 313 is thereby reduced. Further, when the user rotates the rotating member 319 manually, the motor shaft 313*a* is rotated. That is, the steering force to turn the outboard motor main body 30 in the right and left directions is applied to the driving force transmission path leading from the motor 313 to the outboard motor main body 30. This steering force is applied to the upstream side relative to the lock clutch 314 and thus the lock clutch 314 is not locked by the application of the steering force. The steering force applied to the motor shaft 313*a* is thus transmitted to the outboard motor main body 30 through the transmission path. The outboard motor main body 30 is thereby turned manually in the right and left directions. The user can thus turn the outboard motor main body 30 in the right and left directions without using the driving force of the motor 313.

Also, with the sixth preferred embodiment, the rotating member 319 is coupled to the end portion (second end portion) of the motor shaft 313*a* that protrudes to the opposite side with respect to the lock clutch 314 from the motor main body 313*b*. The rotating member 319 is thus arranged in a space with comparative allowance in which the lock clutch 314, etc., is not arranged. Attachment of a tool (the hexagonal wrench 82) to the rotating member 319 is thus easy.

Also, the sixth preferred embodiment is provided with the lid member 634 that is arranged to close the opening portion 31*e* of the swivel bracket 31. The lid member 634 is arranged to be detachable with respect to the swivel bracket 31. By attachment of the lid member 634 to the swivel bracket 31, entry of the water into the inside of the swivel bracket 31 is prevented. Also, by detaching the lid member 634 from the swivel bracket 31, the hexagonal wrench 82 is readily attached to the rotating member 319.

Seventh Preferred Embodiment

Next, an outboard motor 3G according to a seventh preferred embodiment of the present invention shall now be described in detail with reference to FIG. 25 and FIG. 26. First, an arrangement of the outboard motor 3G shall be described in detail.

Figure 25:
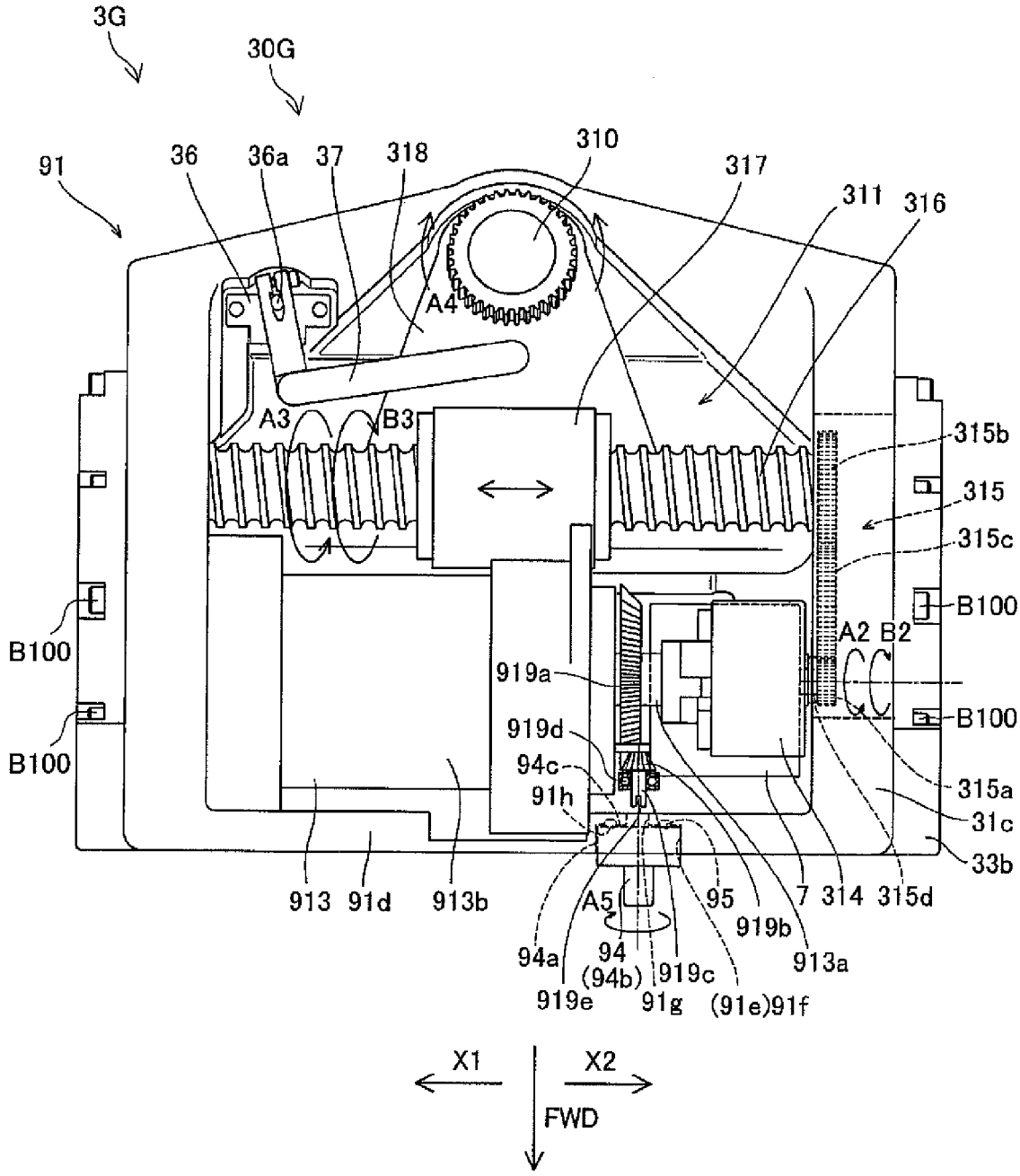
FIG. 25 is a plan view for explaining an arrangement of a swivel bracket according to a seventh preferred embodiment of the present invention.

As shown in FIG. 25, the outboard motor 3G includes an outboard motor main body (not shown), and a steering apparatus 30G arranged to steer the outboard motor main body. Also, the steering apparatus 30G includes a swivel bracket 91, and a motor 913. The swivel bracket 91 is an example of the "swivel portion" according to a preferred embodiment of the present invention.

As shown in FIG. 25, the motor 913 includes a motor shaft 913*a*, and a motor main body 913*b*. The motor shaft 913*a* is arranged along the width direction of the hull 2. The motor shaft 913*a* is arranged to protrude in the width direction of the hull 2 from the motor main body 913*b*. The motor shaft 913*a* includes a first end portion protruding to the lock clutch 314 side from the motor main body 913*b*. A bevel gear 919*a* is coaxially coupled to the first end portion of the motor shaft 913*a*. The bevel gear 919*a* is an example of the "manual steering portion," a "rotating member," and a "driven gear" according to a preferred embodiment of the present invention. The motor shaft 913*a* is arranged to rotate in accordance with rotation of the bevel gear 919*a*.

Also, as shown in FIG. 25, the bevel gear 919*a* coupled to the motor shaft 913*a* is engaged with a bevel gear 919*b*. The bevel gear 919*b* is an example of the "manual steering portion" and a "driving gear" according to a preferred embodiment of the present invention. The bevel gear 919*b* is arranged to rotate about an axis perpendicular or substantially perpendicular to the motor shaft 913*a*. The bevel gear 919*b* is arranged to be rotated manually by the user. The motor shaft 913*a* and the bevel gear 919*a* are arranged to be rotated in accordance with the rotation of the bevel gear 919*b*.

Also, as shown in FIG. 25, the bevel gear 919*b* is coupled to a shaft member 919*c*. The shaft member 919*c* is an example of a "tool engaging member" according to a preferred embodiment of the present invention. The shaft member 919*c* is arranged to protrude forward (to the FWD arrow direction side) from the bevel gear 919*b*. The shaft member 919*c* is supported by a bearing 919*d*. The shaft member 919*c* includes an insertion groove 919*e* provided at a front end portion of the shaft member 919*c*. The insertion groove 919*e* is an example of an "engaging portion" according to a preferred embodiment of the present invention. The insertion groove 919*e* is arranged such that a slotted screwdriver 980 (see FIG. 26) is inserted therein. The slotted screwdriver 980 is an example of a "tool" according to a preferred embodiment of the present invention.

Also, as shown in FIG. 25, the swivel bracket 91 includes an opening portion 91*e* provided in a front wall portion 91*d*. The opening portion 91*e* is arranged to penetrate through the front wall portion 91*d* in the front/rear direction. The opening portion 91*e* is arranged at a position corresponding to the shaft member 919*c*. The slotted screwdriver 980 is inserted from an outside of the swivel bracket 91 into the opening portion 91*e*. The slotted screwdriver 980 is thereby attached to the insertion groove 919*e* of the shaft member 919*c* arranged inside of the swivel bracket 91.

Also, as shown in FIG. 25, the opening portion 91*e* is closed by a lid member 94. The lid member 94 is arranged to be detachable with respect to the swivel bracket 91. Specifically, the opening portion 91*e* includes a threaded portion 91*f* in which a thread is provided, a hole portion 91*g* having a smaller diameter than the threaded portion 91*f*, and a step portion 91*h* provided between the threaded portion 91*f* and the hole portion 91*g*. Also, the lid member 94 includes a threaded portion 94*a* corresponding to the threaded portion 91*f* of the opening portion 91*e*, and a knob portion 94*b* arranged to be held by the user. The lid member 94 is detached from the opening portion 91*e* by the knob portion 94*b* being held and rotated by the user. The slotted screwdriver 980 is inserted from an outside of the swivel bracket 91 into the opening portion 91*e* in a state where the lid member 94 is detached. The slotted screwdriver 980 is thereby attached to the insertion groove 919*e*.

Also, as shown in FIG. 25, an O-ring 95 that seals the interval between the lid member 94 and the opening portion 91*e* is provided at the step portion 91*h* of the opening portion 91*e*. The O-ring 95 is arranged so as to be sandwiched by a bottom portion 94*c* of the lid member 94 and the step portion 91*h* when the lid member 94 is attached to the threaded portion 91*f*. The swivel bracket 91 thereby has a high sealing property.

An operation during manual turning of the outboard motor main body in the right and left directions by the user shall now be described.

Figure 26:
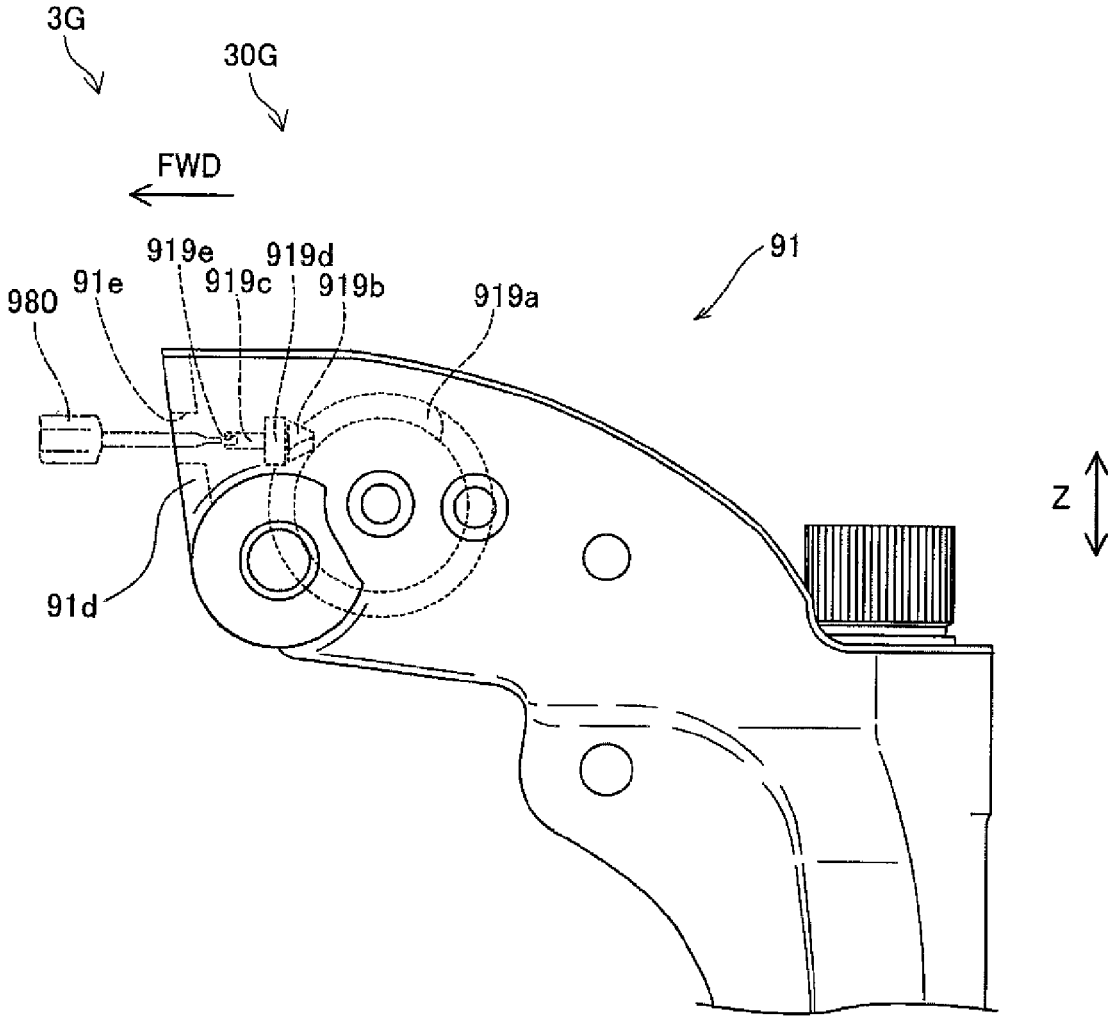
FIG. 26 is a side view for explaining the arrangement of the swivel bracket according to the seventh preferred embodiment of the present invention.

As shown in FIG. 26, the slotted screwdriver 980 is inserted into the opening portion 91*e* in the state where the lid member 94 is detached from the opening portion 91*e*. A tip portion of the slotted screwdriver 980 is then inserted into the insertion groove 919*e*. Thereafter, the slotted screwdriver 980 is rotated in an A5 direction (see FIG. 25). That is, the steering force to turn the outboard motor main body in the right and left directions is applied to the shaft member 919*c*. The shaft member 919*c* and the bevel gear 919*b* are thereby rotated in the A5 direction. In accordance with the rotation of the bevel gear 919*b* in the A5 direction, the bevel gear 919*a* and the motor shaft 913*a* are rotated in the A2 direction (see FIG. 25). The rotation of the motor shaft 913*a* in the A2 direction is transmitted to the input gear 315*a* via the lock clutch 314 and the shaft member 315*d*. The ball screw 316 is thereby rotated in the A3 direction, and the ball nut 317 and the transmission plate 318 are moved in the X1 arrow direction. Consequently, the outboard motor main body is turned in the X1 arrow direction.

Other structures and operations of the seventh preferred embodiment are the same as those of the sixth preferred embodiment.

Next, examples of technical effects and merits of the outboard motor 3G according to the seventh preferred embodiment of the present invention shall now be described.

With the seventh preferred embodiment of the present invention, the outboard motor main body is turned manually in the right and left directions by the user using the slotted screwdriver 980 to rotate the shaft member 919*c*. The user can thus turn the outboard motor main body in the right and left directions without using the driving force of the motor 913.

Also, with the seventh preferred embodiment, the steering force that is applied to the shaft member 919*c* is transmitted to the motor shaft 913*a* via the bevel gear 919*a* and the bevel gear 919*b*. Thus, even in a case where the end portion of the motor shaft 913*a* is arranged in a narrow region between the motor main body 913*b* and the lock clutch 314, the steering force applied to the shaft member 919*c* is transmitted reliably to the motor shaft 913*a*.

Further, the swivel bracket 91 includes the opening portion 91*e* provided in the front wall portion 91*d*. The user can insert the slotted screwdriver 980 into the opening portion 91*e* while on board the marine vessel. Thus, the user can rotate the shaft member 919*c* and turn the outboard motor main body manually in the right and left directions while on board the marine vessel.

Although preferred embodiments of the present invention have been described above, the present invention is not limited to the contents of the first to seventh preferred embodiments, and various changes are possible within the scope of the claims. For example, with each of the first to seventh preferred embodiments, a case where two outboard motors preferably are attached to the hull was described. However, the number of outboard motors may be one or may be not less than three.

Also, with each of the first to seventh preferred embodiments, a case of using the lock clutch, including a mechanical structure, as the lock portion was described. However, an apparatus other than an apparatus including a mechanical structure may be used as the lock portion. For example, an electromagnetic clutch that is driven by electricity may be used as the lock portion.

Also, with each of the first to fifth preferred embodiments, a case where the locking of the outboard motor main body by the lock clutch is preferably released by the intermediate gear, the pin member, the pulley, or the sprocket being moved was described. However, the locking of the outboard motor main body by the lock clutch may be released by operation of a member other than these members. For example, the locking of the outboard motor main body by the lock clutch may be released by severing of a coupling arranged to connect the lock clutch and the input gear.

Figure 27:
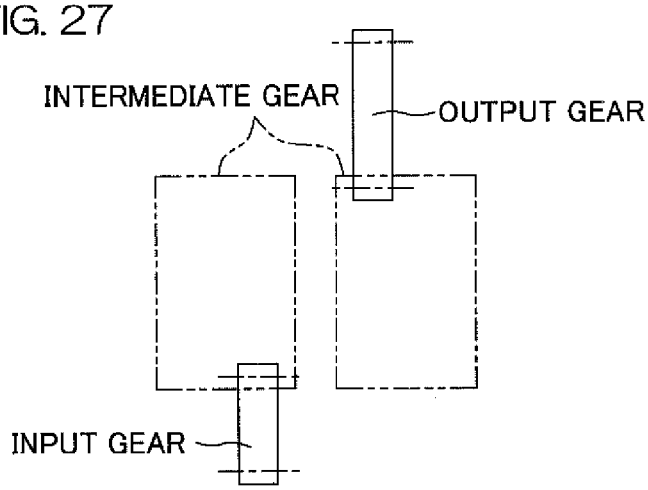
FIG. 27 is a schematic view for explaining an arrangement of an input gear, an intermediate gear, and an output gear according to another preferred embodiment of the present invention.

Also, with each of the first and second preferred embodiments, a case where both the engagement of the intermediate gear and the input gear and the engagement of the intermediate gear and the output gear are released was described. However, one of either the engagement of the intermediate gear and the input gear or the engagement of the intermediate gear and the output gear may be released. Specifically, as shown in FIG. 27, the intermediate gear may be moved between an engaged position (not shown) at which it is engaged with the input gear and the output gear, and a first disengaged position (position indicated by chain lines) at which the engagement with the input gear is released. Or, as shown in FIG. 27, the intermediate gear may be moved between the engaged position (not shown) at which it is engaged with the input gear and the output gear, and a second disengaged position (position indicated by phantom lines) at which the engagement with the output gear is released.

Figure 28:
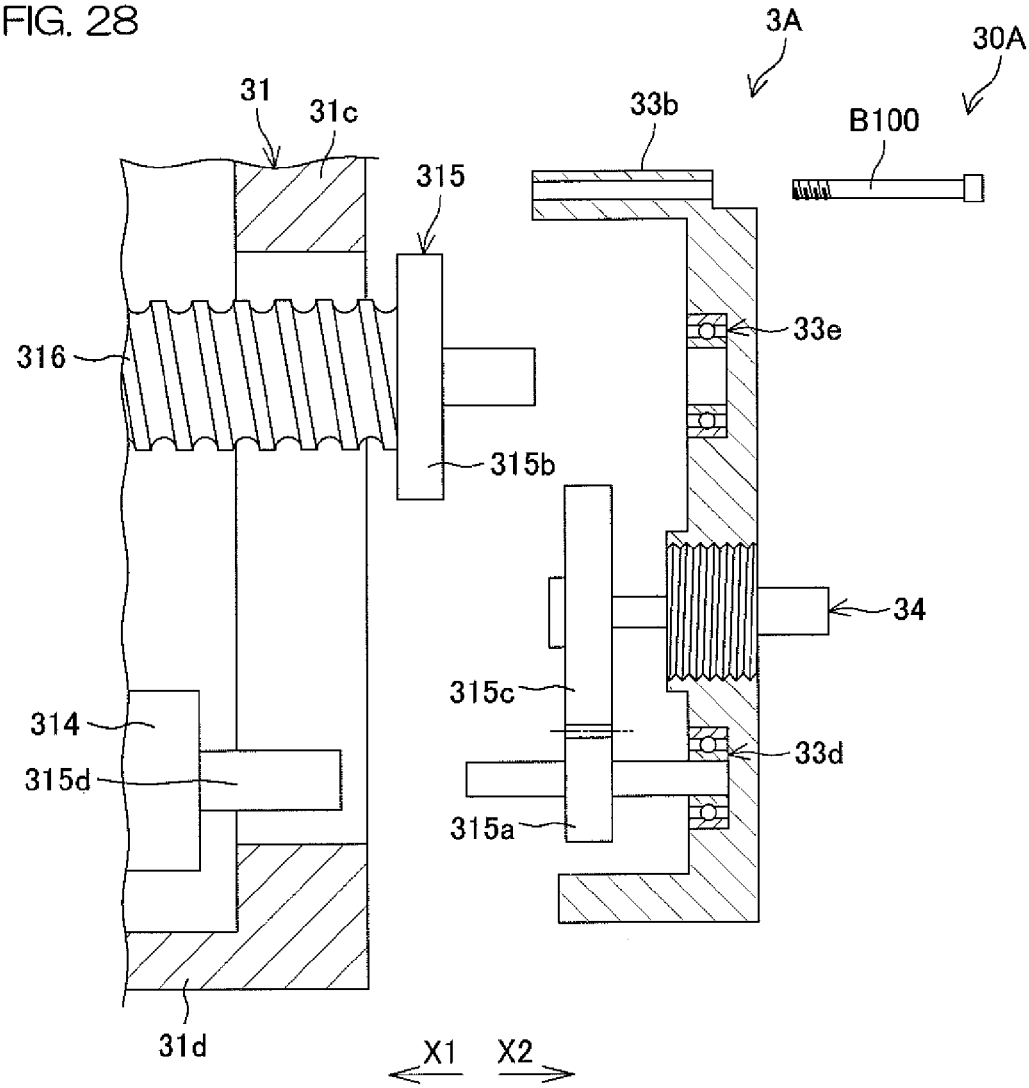
FIG. 28 is a sectional view of a swivel bracket and an arrangement related thereto according to yet another preferred embodiment of the present invention.

Also, with each of the first and second preferred embodiments, a case where the transmission of force by the gear mechanism is preferably stopped by the intermediate gear being moved in the inside of the plate member was described. However, the transmission of force by the gear mechanism may be stopped instead by the plate member being removed from the swivel bracket. Specifically, the plate member 33*b* may be detached from the side wall 31*c* of the swivel bracket 31 as shown in FIG. 28. When the plate member 33*b* is detached from the side wall 31*c*, the input gear 315*a* and the intermediate gear 315*c*, held by the plate member 33*b*, are separated from the side wall 31*c*. The coupling of the input gear 315*a* and the shaft member 315*d* and the engagement of the intermediate gear 315*c* and the output gear 315*b* are thereby released and the transmission of force by the gear mechanism 315 is stopped. The plate member 33*b* is an example of the "lock release mechanism" and the "holding member" according to a preferred embodiment of the present invention.

Also, with each of the second and sixth preferred embodiments, a case where the rotating member is rotated preferably using the hexagonal wrench was described. With the seventh preferred embodiment, a case where the shaft member is rotated preferably using the slotted screwdriver was described. However, the rotating member and the shaft member may be arranged to be rotated using a tool other than the hexagonal wrench or the slotted screwdriver. The tool other than the hexagonal wrench or the slotted screwdriver may be of any form, such as a Phillips screwdriver, as long as it is arranged to rotate the rotating member or the shaft member.

Also, with each of the second, sixth, and seventh preferred embodiments, a case where the rotating member or the shaft member is rotated preferably using a tool was described. However, the rotating member or the shaft member may be arranged to be rotated directly by the user without the use of a tool. In this case, the rotating member or the shaft member may each include, for example, a dial lever arranged to be rotated directly by the user.

The present application corresponds to Japanese Patent Application Nos. 2009-5820 and 2009-5917 respectively filed on Jan. 14, 2009 and Jan. 20, 2009 in the Japan Patent Office, and the entire disclosures of these applications are incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a driver arranged to control the motor according to an electrical signal transmitted from a steering portion of the steering apparatus;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions; and a lock release mechanism provided in the transmission path at a downstream side relative to the lock portion and arranged to stop a transmission of force to an upstream side of the lock release mechanism to thereby prevent application of the force to the lock portion.

2. The steering apparatus for a propulsion device according to claim 1, further comprising a transmitting mechanism provided in the transmission path at the downstream side relative to the lock portion and arranged to transmit a force from an upstream side to a downstream side of the transmitting mechanism and from the downstream side to the upstream side transmitting mechanism, wherein the lock release mechanism is arranged to stop a transmission of force by the transmitting mechanism.

3. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions; and a lock release mechanism provided in the transmission path at a downstream side relative to the lock portion and arranged to stop a transmission of force to an upstream side of the lock release mechanism to thereby prevent application of the force to the lock portion; wherein the transmitting mechanism includes a gear mechanism including a plurality of engaged gears, and the lock release mechanism is arranged to release an engagement of at least one pair of the plurality of engaged gears.

4. The steering apparatus for a propulsion device according to claim 3, wherein the gear mechanism includes an input gear arranged such that the driving force of the motor is transmitted to the input gear, an output gear arranged to output the driving force, and an intermediate gear engaged with the input gear and the output gear and arranged to transmit the driving force from the input gear to the output gear; and the lock release mechanism is arranged to release at least one of either an engagement of the input gear with the intermediate gear or an engagement of the output gear with the intermediate gear.

5. The steering apparatus for a propulsion device according to claim 2, wherein the transmitting mechanism includes a gear mechanism including a plurality of engaged gears, and the lock release mechanism further includes a holding member detachably coupled to the swivel portion and arranged to hold at least one of the plurality of engaged gears.

6. The steering apparatus for a propulsion device according to claim 3, wherein the lock release mechanism includes an operating portion arranged to be operated manually at an outside of the swivel portion and arranged such that an engagement of at least one pair of gears among the plurality of engaged gears is released by performing a release operation.

7. The steering apparatus for a propulsion device according to claim 6, wherein the operating portion is arranged such that at least one of the plurality of engaged gears is moved in a predetermined direction by the release operation and is arranged such that the gear that has been moved by the release operation is moved in a direction opposite to the predetermined direction by performing a return operation.

8. The steering apparatus for a propulsion device according to claim 1, further comprising a transmission member provided in the transmission path at a downstream side relative to the lock release mechanism and arranged to transmit a force to a downstream side of the transmission member by being rotated, and a manual steering portion arranged to rotate the transmission member by being operated manually in a state in which a locking of the propulsion device main body by the lock portion is released.

9. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions;

a lock release mechanism provided in the transmission path at a downstream side relative to the lock portion and arranged to stop a transmission of force to an upstream side of the lock release mechanism to thereby prevent application of the force to the lock portion;

a swivel shaft arranged along a turning axis of the propulsion device main body and arranged to be turned about the turning axis by the motor; and a coupling member coupled to the propulsion device main body; wherein the lock release mechanism includes a pin member detachably attached to the swivel shaft and the coupling member and arranged to couple the swivel shaft and the coupling member such that the swivel shaft and the coupling member turn integrally about the turning axis.

10. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions;

a lock release mechanism provided in the transmission path at a downstream side relative to the lock portion and arranged to stop a transmission of force to an upstream side of the lock release mechanism to thereby prevent application of the force to the lock portion; and a transmitting mechanism provided in the transmission path at the downstream side relative to the lock portion and arranged to transmit a force from an upstream side to a downstream side of the transmitting mechanism and from the downstream side to the upstream side transmitting mechanism; wherein the lock release mechanism is arranged to stop a transmission of force by the transmitting mechanism; and the transmitting mechanism includes a pulley detachably coupled to the lock portion, and a belt attached to the pulley and arranged to transmit a force, which is applied to the pulley, to a downstream side of the transmission path; and the lock release mechanism is arranged to detach the pulley from the lock portion.

11. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions;

a lock release mechanism provided in the transmission path at a downstream side relative to the lock portion and arranged to stop a transmission of force to an upstream side of the lock release mechanism to thereby prevent application of the force to the lock portion; and a transmitting mechanism provided in the transmission path at the downstream side relative to the lock portion and arranged to transmit a force from an upstream side to a downstream side of the transmitting mechanism and from the downstream side to the upstream side transmitting mechanism; wherein the lock release mechanism is arranged to stop a transmission of force by the transmitting mechanism; and the transmitting mechanism includes a sprocket detachably coupled to the lock portion, and a chain attached to the sprocket and arranged to transmit a force, which is applied to the sprocket, to a downstream side in the transmission path; and the lock release mechanism is arranged to detach the sprocket from the lock portion.

12. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a driver arranged to control the motor according to an electrical signal transmitted from a steering portion of the steering apparatus;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions; and a manual steering portion provided in the transmission path at an upstream side relative to the lock portion and arranged to be operated manually to apply a steering force, which turns the propulsion device main body in the right and left directions, to the transmission path.

13. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions; and a manual steering portion provided in the transmission path at an upstream side relative to the lock portion and arranged to be operated manually to apply a steering force, which turns the propulsion device main body in the right and left directions, to the transmission path; wherein the motor includes a motor main body and a motor shaft protruding from the motor main body, and the manual steering portion includes a rotating member integrally coupled to the motor shaft in an inside of the swivel portion and arranged to be rotated from an outside of the swivel portion.

14. The steering apparatus for a propulsion device according to claim 13, wherein the motor shaft includes a first end portion protruding to the lock portion side from the motor main body, and the rotating member is coupled to the first end portion.

15. The steering apparatus for a propulsion device according to claim 13, wherein the motor shaft includes a first end portion protruding to the lock portion side from the motor main body, and a second end portion protruding to an opposite side with respect to the lock portion from the motor main body, and the rotating member is coupled to the second end portion.

16. A steering apparatus for a propulsion device, the steering apparatus comprising:

a swivel portion arranged to attach a propulsion device main body to a hull such that the propulsion device main body is capable of turning in right and left directions;

a motor located at the swivel portion and arranged to generate a driving force to turn the propulsion device main body in the right and left directions;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions; and a manual steering portion provided in the transmission path at an upstream side relative to the lock portion and arranged to be operated manually to apply a steering force, which turns the propulsion device main body in the right and left directions, to the transmission path; wherein the manual steering portion is arranged inside of the swivel portion, and the swivel portion includes an opening portion arranged to cause the inside of the swivel portion to communicate with an outside of the swivel portion and arranged at a position corresponding to the manual steering portion.

17. The steering apparatus for a propulsion device according to claim 13, wherein the rotating member includes a driven gear integrally coupled to the motor shaft, and the manual steering portion includes a drive gear engaged with the driven gear and arranged to be rotated manually.

18. The steering apparatus for a propulsion device according to claim 17, wherein the manual steering portion includes a tool engaging member arranged to rotate together with the drive gear about a rotation axis of the drive gear, the tool engaging member including an engaging portion, which is arranged to engage with a tool, arranged to be rotated about the rotation axis of the drive gear by the tool.

19. A propulsion device comprising:

a propulsion device main body; and a steering apparatus arranged to steer the propulsion device main body; wherein the steering apparatus includes:

a swivel portion arranged to attach the propulsion device main body to a hull such that the propulsion device main body is capable of turning in right and left directions;

a motor located at the swivel portion and arranged to generate a driving force to turn the propulsion device main body in the right and left directions;

a driver arranged to control the motor according to an electrical signal transmitted from a steering portion of the steering apparatus;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions; and a lock release mechanism provided in the transmission path at a downstream side relative to the lock portion and arranged to stop transmission of a force to an upstream side of the lock release mechanism to thereby prevent application of the force to the lock portion.

20. A propulsion device including:

a propulsion device main body; and a steering apparatus arranged to steer the propulsion device main body; wherein the steering apparatus includes:

a swivel portion arranged to attach the propulsion device main body to a hull such that the propulsion device main body is capable of turning in right and left directions;

a motor located at the swivel portion and arranged to generate a driving force to turn the propulsion device main body in the right and left directions;

a driver arranged to control the motor according to an electrical signal transmitted from a steering portion of the steering apparatus;

a lock portion provided in a transmission path of the driving force and arranged to transmit a force from an upstream side to a downstream side of the lock portion and to be locked when a force is applied from the downstream side to thereby prevent turning of the propulsion device main body in the right and left directions; and a manual steering portion provided in the transmission path at an upstream side relative to the lock portion and arranged to be operated manually to apply a steering force, which turns the propulsion device main body in the right and left directions, to the transmission path.

* * * * *